US007942493B2

(12) United States Patent
Watanabe

(10) Patent No.: US 7,942,493 B2
(45) Date of Patent: May 17, 2011

(54) IMAGE FORMING APPARATUS

(75) Inventor: Masaru Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 999 days.

(21) Appl. No.: 11/821,001

(22) Filed: Jun. 20, 2007

(65) Prior Publication Data

US 2008/0007587 A1 Jan. 10, 2008

(30) Foreign Application Priority Data

Jul. 7, 2006 (JP) ..... 2006-188006

(51) Int. Cl.

| | |
|---|---|
| ***B41J 29/393*** | (2006.01) |
| ***B41J 3/00*** | (2006.01) |
| ***B41J 29/38*** | (2006.01) |
| ***B41J 25/308*** | (2006.01) |
| ***B41J 2/205*** | (2006.01) |
| ***B41J 2/165*** | (2006.01) |
| ***B41J 23/00*** | (2006.01) |

(52) U.S. Cl. ..... 347/19; 347/4; 347/6; 347/8; 347/14; 347/15; 347/22; 347/23; 347/34; 347/37

(58) Field of Classification Search ..... 347/4, 6, 347/8, 14, 15, 19, 22, 23, 34, 37
See application file for complete search history.

(56) References Cited

U.S. PATENT DOCUMENTS

| | | | | |
|---|---|---|---|---|
| 6,000,776 | A * | 12/1999 | Suzuki et al. | 347/19 |
| 6,213,580 | B1 * | 4/2001 | Segerstrom et al. | 347/19 |
| 6,454,382 | B1 * | 9/2002 | Galentovski | 347/19 |
| 6,578,945 | B2 * | 6/2003 | Hashi et al. | 347/22 |
| 2005/0052488 | A1 * | 3/2005 | Inoue | 347/19 |

FOREIGN PATENT DOCUMENTS

| | | |
|---|---|---|
| JP | 2004-255752 | 9/2004 |
| JP | 2004-291651 | 10/2004 |
| JP | 2005-335343 | 12/2005 |
| JP | 2005-342899 | 12/2005 |

* cited by examiner

*Primary Examiner* — Charlie Peng
*Assistant Examiner* — Hung Lam
(74) *Attorney, Agent, or Firm* — Cooper & Dunham LLP

(57) ABSTRACT

A disclosed image forming apparatus for forming an image on a recording medium includes an inkjet head having a nozzle surface and inkjet nozzles on the nozzle surface and configured to jet ink droplets from the inkjet nozzles; a recording medium conveying mechanism including a recording medium conveyor and configured to convey the recording medium by the recording medium conveyor into an image forming area facing the inkjet head; a test pattern forming part provided separately from the recording medium conveyor; a control unit configured to perform an image forming test where a test pattern is formed on the test pattern forming part by jetting ink droplets from the inkjet head; and a test pattern detection unit configured to detect the test pattern formed on the test pattern forming part.

19 Claims, 14 Drawing Sheets

IMAGE FORMING APPARATUS

BACKGROUND

1. Technical Field

This disclosure generally relates to an inkjet image forming apparatus including an inkjet head having inkjet nozzles for jetting ink onto a recording medium and a recording medium conveyor for conveying a recording medium into a position facing the inkjet head.

2. Description of the Related Art

In an inkjet image forming apparatus, positional deviation (deviation from correct landing positions) of ink droplets jetted onto a recording medium may be caused, for example, by performance degradation of an inkjet head over time or viscosity change of ink due to temperature change. Positional deviation of ink droplets in turn degrades image quality. If the situation is left uncorrected, positional deviation of ink droplets may become worse and image quality may be degraded further.

Patent document 1 discloses an image forming apparatus configured to form a test pattern on a recording medium and to detect the test pattern by a test pattern detection unit. The disclosed image forming apparatus determines based on the detected test pattern whether ink droplets are in correct landing positions and if positional deviation of ink droplets is found, performs corrective actions to correct the positional deviation. Thus, the disclosed image forming apparatus can prevent degradation of image quality resulting from positional deviation of ink droplets by performing corrective actions based on the results of examining a test pattern. One disadvantage of the disclosed image forming apparatus is that it consumes recording media to form test patterns.

Patent document 2 discloses an image forming apparatus configured to form a test pattern on a recording medium conveying belt outside of an area where a recording medium is placed, to detect the test pattern by a test pattern detection unit, and to perform corrective actions based on the results of examining the detected test pattern. Thus, the image forming apparatus disclosed in patent document 2 does not require recording media to form test patterns.

[Patent document 1] Japanese Patent Application Publication No. 2004-255752

[Patent document 2] Japanese Patent Application Publication No. 2005-342899

Although forming a test pattern on a recording medium conveying belt has an advantage as described above, it may also cause some problems.

For example, if a test pattern is formed on a recording medium conveying belt in an area where recording media are placed, ink remaining on the recording medium conveying belt may smear the back sides of recording media. The image forming apparatus disclosed in patent document 2 prevents this problem by providing a test pattern forming area in a side area (outside of an area where recording media are placed) of the recording medium conveying belt and forming a test pattern in the test pattern forming area. However, to provide a test pattern forming area, it is necessary to increase the width of a recording medium conveying belt.

In an inkjet image forming apparatus, it is necessary to convey a recording medium with high accuracy into a position facing an inkjet head. The accuracy of conveying a recording medium is influenced by manufacturing errors and assembly errors of parts constituting a recording medium conveying mechanism and the influence becomes greater as the width of a recording medium conveying belt increases. For example, as the width of a recording medium conveying belt increases, the difference between conveying speeds at side edges of the recording medium conveying belt may become larger or a positional shift of the recording medium conveying belt may become greater. Thus, increasing the width of a recording medium conveying belt may reduce the accuracy of conveying a recording medium. Therefore, it is preferable to make the width of a recording medium conveying belt as small as possible to convey a recording medium with high accuracy. Referring to the image forming apparatus disclosed in patent document 2 again, its recording medium conveying belt has a large width to provide a test pattern forming area. This configuration may make it difficult to convey a recording medium with high accuracy.

Also, increasing the width of a recording medium conveying belt may result in an increased size of an image forming apparatus.

In some image forming apparatuses, an AC power supply is connected to a recording medium conveying belt to electrostatically charge the recording medium conveying belt so that a recording medium is attracted to the recording medium conveying belt and is more stably conveyed. When ink (which is also charged) is jetted onto an electrostatically-charged recording medium conveying belt, it is repelled by an electric field on the recording medium conveying belt and floats as a mist in the air. If the floating mist of ink adheres to an area on the recording medium conveying belt where recording media are placed, the ink may smear the back sides of the recording media.

Thus, forming a test pattern on a recording medium conveying belt causes various problems.

BRIEF SUMMARY

In an aspect of this disclosure, there is provided an inkjet image forming apparatus configured to form and detect a test pattern on a test pattern forming part provided separately from a recording medium conveyor.

In another aspect, an image forming apparatus for forming an image on a recording medium includes an inkjet head having a nozzle surface and inkjet nozzles on the nozzle surface and configured to jet ink droplets from the inkjet nozzles; a recording medium conveying mechanism including a recording medium conveyor and configured to convey the recording medium by the recording medium conveyor into an image forming area facing the inkjet head; a test pattern forming part provided separately from the recording medium conveyor; a control unit configured to perform an image forming test where a test pattern is formed on the test pattern forming part by jetting ink droplets from the inkjet head; and a test pattern detection unit configured to detect the test pattern formed on the test pattern forming part.

DESCRIPTION OF THE PREFERRED EMBODIMENTS

Preferred embodiments of the present invention are described below with reference to the accompanying drawings.

An exemplary configuration of a printer 1 according to an embodiment of the present invention is described below.

Figure 1:
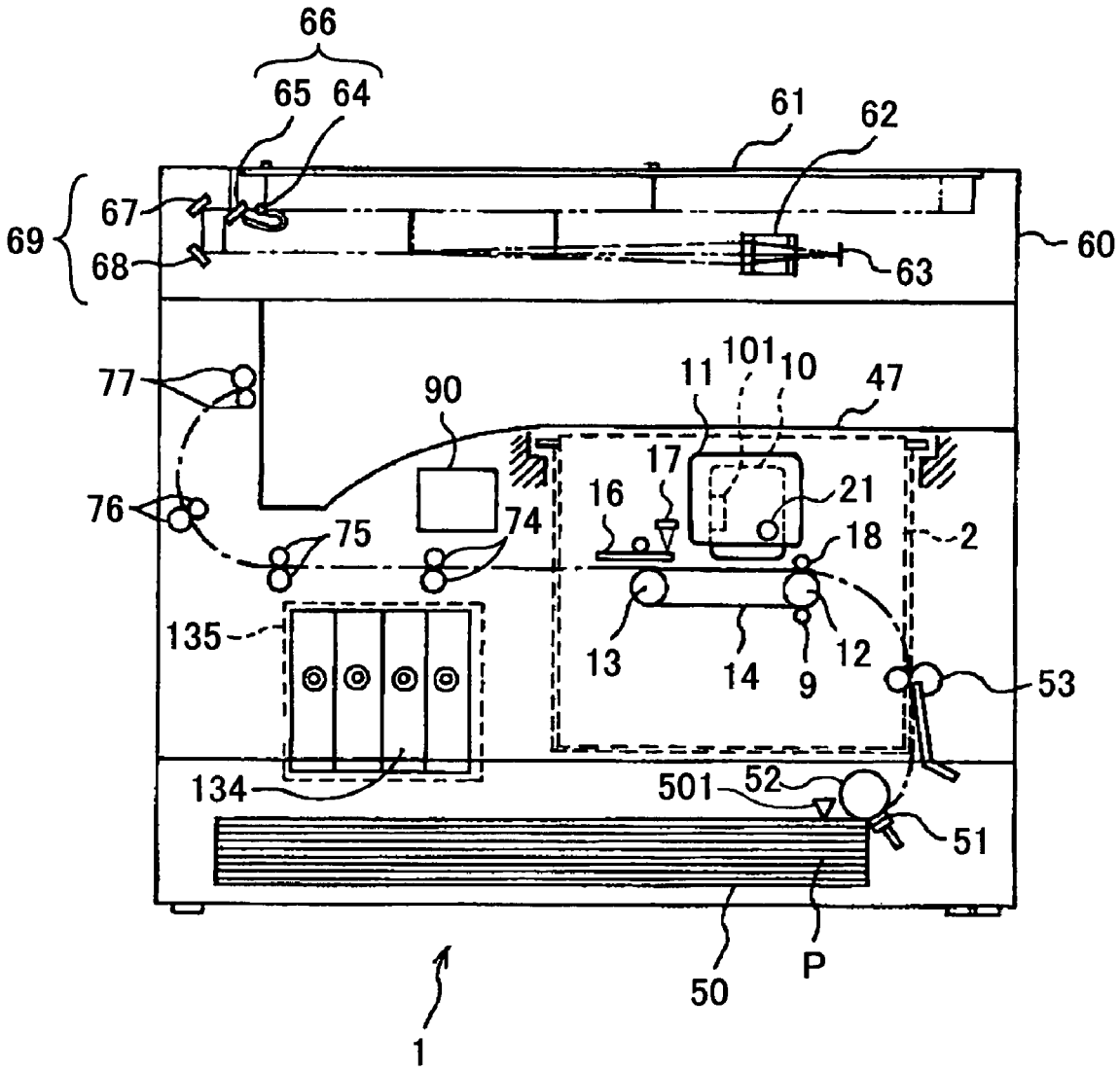
FIG. 1 is a drawing illustrating a configuration of an exemplary printer.

FIG. 1 is a drawing illustrating an exemplary configuration of the printer 1. The printer 1 includes an image forming unit 2 for forming an image and a paper feed tray 50 for holding paper sheets P. The image forming unit 2 includes a carriage 11. The paper feed tray 50 can be pulled out from the front side of the printer 1 (in a direction perpendicular to the printed page). The printer 1 also includes an image scanning unit 60 for scanning a document above the image forming unit 2. The carriage 11 includes inkjet heads 10 each having inkjet nozzles for jetting ink on its under surface (nozzle surface). A control unit 90 for controlling other units of the printer 1 is provided on the left of the image forming unit 2.

The carriage 11 is supported by a guide rod 21 and a carriage support (not shown) so as to be able to move in the main-scanning direction (from the front to the rear of the printer 1 and in the opposite direction). The guide rod 21 runs through the carriage 11 and is laid between front and rear panels of the printer 1. The carriage support extends in parallel with the guide rod 21 at a uniform distance.

The printer 1 also includes a cartridge holder 135 holding ink cartridges 134 (first ink containers) containing color inks. The ink cartridges 134 are detachable from the cartridge holder 135.

Color inks contained in the ink cartridges 134 are supplied to corresponding second ink containers in the inkjet heads 10 via ink supply tubes (not shown). Ink temperature sensors 101 (ink temperature detection units) are provided at least for the first ink containers (ink cartridges 134) or for the second ink containers. In FIG. 1, the ink temperature sensors 101 are provided in the second ink containers of the inkjet heads 10.

The image scanning unit 60 includes a first moving member 66 and a second moving member 69 for scanning a document placed on a contact glass 61. The first moving member 66 and the second moving member 69 are movable back and forth. The first moving member 66 includes a document illuminating light source 64 and a first mirror 65. The second moving member 69 includes a second mirror 67 and a third mirror 68. An optical image from a document scanned by the first and second moving members 66 and 69 is received and converted into an image signal by an image sensor 63 such as a CCD positioned downstream of a lens 62. The image signal is digitized and image processing is performed on the digital image signal. The image forming unit 2 forms an image on the paper sheet P based on the processed image signal.

The printer 1 can receive image data from other apparatuses via a communication cable or a network, process the received image data, and form an image with the image forming unit 2 based on the processed image data. Examples of the other apparatuses include information processing apparatuses such as personal computers, image scanning apparatuses, and imaging apparatuses such as digital cameras.

The printer 1 further includes a maintenance/cleaning unit (not shown). The maintenance/cleaning unit is positioned such that it faces the carriage 11 when the carriage 11 is in a home position. The maintenance/cleaning unit includes a cleaner for cleaning nozzle surfaces of the inkjet heads 10, suction caps for suctioning ink from the nozzle surfaces, and moisture retention caps for retaining moisture of the nozzle surfaces. When not active, the carriage 11 returns to the home position where the nozzle surfaces are covered by the moisture retention caps.

An exemplary process of forming a full-color image in the printer 1 is described below.

When a document is placed on the contact glass 61 of the image scanning unit 60 and the start button is pressed, the first and second moving members 66 and 69 are driven. The document illuminating light source 64 of the first moving member 66 illuminates the document. Reflected light from the document is diverted by the first mirror 65 toward the second moving member 69. The light from the first mirror 65 is again reflected by the second and third mirrors 67 and 68 of the second moving member 69 and enters the image sensor 63 via the lens 62. Thus, image data (or an image signal) are generated by scanning a document. Alternatively, image data may be sent from another apparatus such as a personal computer via a communication cable or a network.

Then, the paper sheets P are fed from the paper feed tray 50 one by one by a separating roller 52 and a friction pad 51. When each of the paper sheets P is fed from the paper feed tray 50, a paper thickness sensor 501 (recording medium thickness detection unit) detects its thickness. The paper sheet P is fed further by paper-feeding rollers 53 into the image forming unit 2. In the image forming unit 2, the paper sheet P is pressed onto a conveyor belt 14 (recording medium conveyor) by a pressing roller 18. Since the surface of the conveyor belt 14 is charged by a charging roller 9, the paper sheet P is electrostatically attracted to the conveyor belt 14. The paper sheet P is conveyed into a position facing the carriage 11 by the conveyor belt 14. When the paper sheet P reaches the position facing the carriage 11, the conveyor belt 14 stops.

Before an image signal is received, the carriage 11 is in the home position facing the maintenance/cleaning unit. In the home position, as described above, the nozzle surfaces of the inkjet heads 10 are covered by the moisture retention caps so that the moisture of the inkjet nozzles is retained. When an image signal is received, the moisture retention caps descend and the carriage 11 starts moving along the main-scanning direction (from the front to the rear of the printer 1 and in the opposite direction). While the carriage 11 is moving along the main-scanning direction, the inkjet heads 10 jet ink droplets according to the image signal and thereby form a line of an image on the paper sheet P that is caused to pause at a position. A "line" in this case means a range of an image that the inkjet heads 10 can form in one image forming path in the recording medium conveying direction (a direction the paper sheet P is conveyed; from right to left in FIG. 1). After one line of an image is formed, the conveyor belt 14 is moved for a specified period of time to convey the paper sheet P for one line in the recording medium conveying direction. Then, the inkjet heads 10 of the carriage 11 form another line of the image on the paper sheet P in the same manner as described above. The entire image is formed on the paper sheet P by repeating the above steps. Being electrostatically attracted to the conveyor belt 14, the paper sheet P can be steadily conveyed during the above steps into the position facing the inkjet heads 10. Also, the pressing roller 18 pressing the paper sheet P onto the conveyor belt 14 ensures that the paper sheet P is electrostatically attracted to the conveyor belt 14. After an image is formed, the paper sheet P is ejected onto a paper catch tray 47 by paper ejecting rollers 74, 75, 76, and 77 composed of rollers and spurs.

Then, the carriage 11 returns to the home position facing the maintenance/cleaning unit. When the carriage 11 returns to the home position, the moisture retention caps ascend and cover the nozzle surfaces of the inkjet heads 10.

Meanwhile, the control unit 90 of the printer 1 includes an image forming test control unit for controlling an image forming test. In an image forming test, the image forming test control unit forms a test pattern by causing the inkjet heads 10 to jet ink droplets onto a test pattern forming plate 16 (test pattern forming part). A test pattern detection unit 17 then detects the test pattern formed on the test pattern forming plate 16. The control unit 90 (or the image forming test control unit) determines based on the test pattern detected by the test pattern detection unit 17 whether the ink droplets are in correct landing positions and if positional deviation of ink droplets is found, a corrective action control unit of the control unit 90 performs corrective actions to correct the positional deviation. Thus, the printer 1 is configured to prevent positional deviation of ink droplets by performing corrective actions as needed and thereby to maintain image quality.

As described above, an image forming apparatus disclosed in patent document 2 is configured to form a test pattern on a test pattern forming area provided on a conveyor belt outside of an area where a recording medium is placed. Such a configuration makes it necessary to increase the width of a conveyor belt in the main-scanning direction to provide a test pattern forming area and may result in an increased size of an image forming apparatus. Also, when ink is jetted onto an electrostatically-charged conveyor belt, the ink may be repelled by an electric field on the conveyor belt and float as a mist in the air. If the floating mist of ink adheres to an area on the conveyor belt where recording media are placed, the ink may smear the back sides of recording media.

Since the test pattern forming plate 16 of the printer 1 is provided separately from the conveyor belt 14, it is not necessary to increase the width of the conveyor belt 14 to provide a test pattern forming area. The accuracy of conveying a recording medium is influenced by manufacturing errors and assembly errors of parts constituting a recording medium conveying mechanism and the influence becomes greater as the width of a conveyor belt increases. The above described configuration according to an embodiment of the present invention enables making the width of a conveyor belt as small as possible and thereby improving the accuracy of conveying a recording medium. Also, reducing the width of the conveyor belt 14 makes it possible to reduce the overall size of a recording medium conveying mechanism including the conveyor belt 14, a belt driving roller 12, and a belt driven roller 13.

Further, although the conveyor belt 14 of the printer 1 is electrostatically charged to steadily convey the paper sheet P, since a test pattern is formed on the test pattern forming plate 16 provided separately from the conveyor belt 14, a mist of ink is not formed. In other words, with the above configuration according to an embodiment of the present invention, the paper sheet P is not smeared by a mist of ink adhering to the conveyor belt 14.

An image forming apparatus disclosed in patent document 1 is configured to form a test pattern on a recording medium, to detect the test pattern, and to perform corrective actions based on the results of examining the test pattern. One disadvantage of the disclosed image forming apparatus is that it consumes recording media to form test patterns. Also, the examination results may differ depending on the size and orientation of a recording medium used.

The printer 1 of this embodiment forms a test pattern on the test pattern forming plate 16 and therefore does not require recording media in an image forming test. Also, results of an image forming test are not influenced by the size and orientation of a recording medium.

First Embodiment

An exemplary image forming unit including a recording medium conveyor and a separate test pattern forming part according to a first embodiment is described below.

Figure 2:
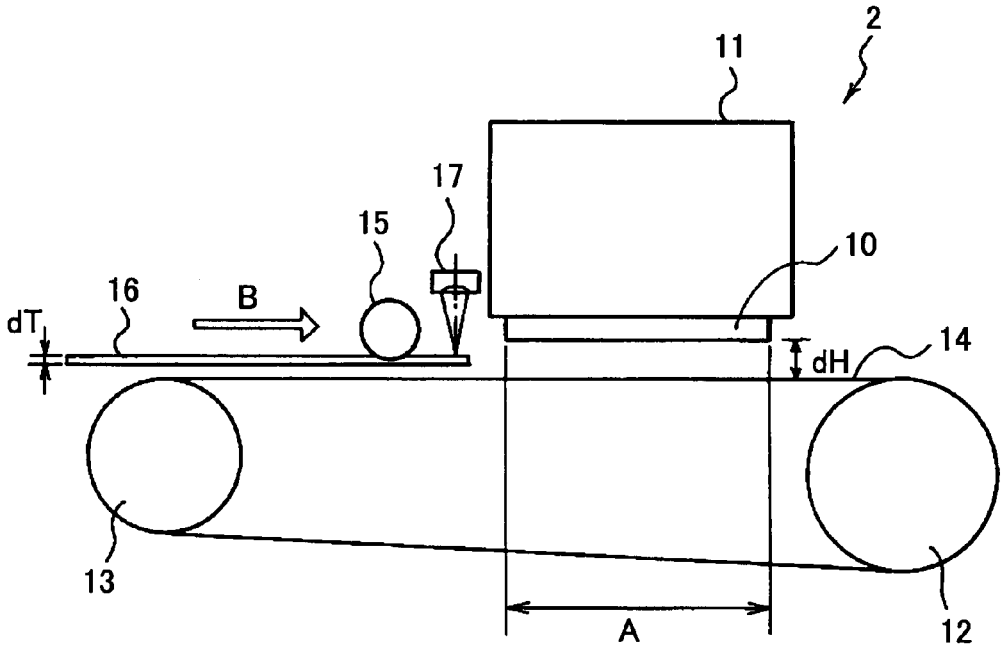
FIG. 2 is a side view of an exemplary image forming unit according to a first embodiment where no test pattern is being formed.
Figure 3:
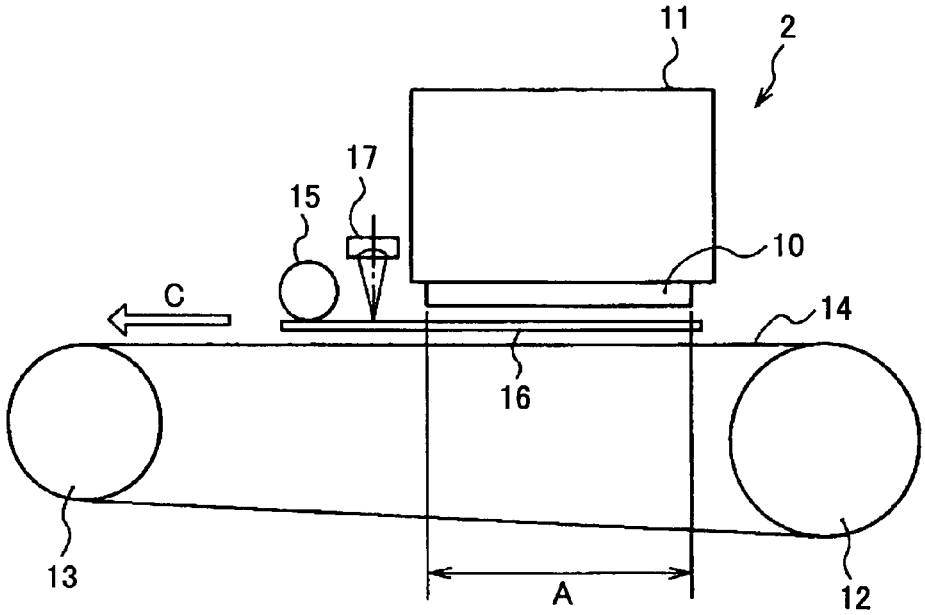
FIG. 3 is a side view of the exemplary image forming unit of the first embodiment where a test pattern is being formed.

FIGS. 2 and 3 are side views of the image forming unit 2 of the printer 1 according to the first embodiment. FIG. 2 is a side view of the image forming unit 2 where no test pattern is being formed and FIG. 3 is a side view of the image forming unit 2 where a test pattern is being formed. In the image forming unit 2, a paper sheet P is conveyed by the conveyor belt 14 and is caused to pause in an image forming area A facing the inkjet heads 10 of the carriage 11 in which image forming area A ink droplets are jetted from the inkjet heads 10 onto the paper sheet P. The carriage 11 having the inkjet heads 10 is movable in the main-scanning direction (from the front to the rear and in the opposite direction in FIG. 2) at a uniform distance above the conveyor belt 14. The image forming area A corresponds to an area over which the carriage 11 can move.

As shown in FIG. 2, when no test pattern is being formed, the test pattern forming plate 16 (test pattern forming part) is positioned downstream of the image forming area A in the recording medium conveying direction. When a command to perform an image forming test is issued from the control unit 90, the test pattern forming plate 16 moves in a direction indicated by an arrow B into the image forming area A. In the image forming area A, as shown in FIG. 3, a test pattern is formed on the upper surface of the test pattern forming plate 16 by the inkjet heads 10.

A thickness dT of the test pattern forming plate 16 is smaller than a gap dH between the nozzle surfaces of the inkjet heads 10 and the upper surface of the conveyor belt 14. Thus, the test pattern forming plate 16 can be moved into the image forming area A between the nozzle surfaces of the inkjet heads 10 and the upper surface of the conveyor belt 14.

Also, the image forming unit 2 may be configured such that the height of the carriage 11 from the upper surface of the conveyor belt 14 can be changed. With this configuration, the carriage 11 is moved upward when the test pattern forming plate 16 is moved into the image forming area A and, therefore, the gap dH during normal image forming can be smaller than the thickness dT.

After a test pattern is formed, the test pattern forming plate 16 is moved in a direction indicated by an arrow C in FIG. 3 into a test pattern forming plate home position outside of the image forming area A.

The image forming unit 2 of the first embodiment includes a test pattern detection unit 17 between the test pattern forming plate home position and the carriage 11. The test pattern detection unit 17 is configured to detect a test pattern on the test pattern forming plate 16 at a position in a path along which the test pattern forming plate 16 moves under the test pattern detection unit 17 from the image forming area A to the test pattern plate home position. Alternatively, the test pattern detection unit 17 may be provided on the carriage 11.

The image forming unit 2 of the first embodiment also includes a cleaning roller 15 (cleaning unit) between the test pattern forming plate home position and the image forming area A. The cleaning roller 15 is in contact with the test pattern forming plate 16 and wipes off (or removes) the test pattern formed on the test pattern forming plate 16. This mechanism makes it possible to use the test pattern forming plate 16 repeatedly. As shown in FIGS. 2 and 3, the cleaning roller 15 is situated closer to the test pattern forming plate home position than the test pattern detection unit 17. Accordingly, a test pattern formed on the test pattern forming plate 16 is detected by the test pattern detection unit 17 and is then wiped off by the cleaning roller 15.

A water-repellent layer may be formed on the upper surface of the test pattern forming plate 16. Ink jetted from the inkjet heads 10 onto the water-repellent layer of the test pattern forming plate 16 remains in the form of droplets and does not penetrate into the water-repellent layer. This makes it possible for the cleaning roller 15 to completely wipe off the test pattern. Also, with the water-repellent layer, ink droplets do not spread much. This makes it possible for the test pattern detection unit 17 to accurately detect landing positions of ink droplets.

Figure 4:
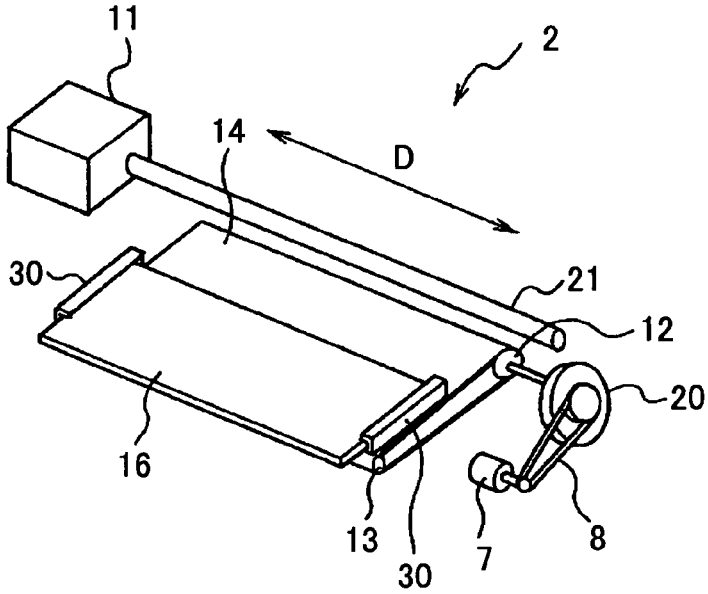
FIG. 4 is a perspective view of the exemplary image forming unit of the first embodiment.
Figure 5:
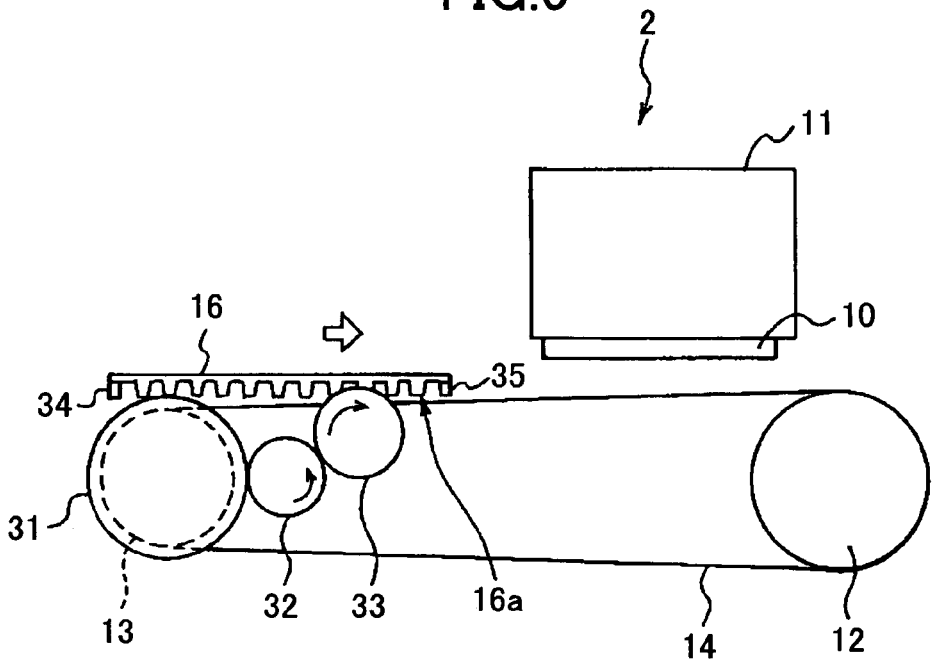
FIG. 5 is a drawing illustrating a driving unit for moving a test pattern forming plate.

Next, an exemplary mechanism for moving the test pattern forming plate 16 between the test pattern forming plate home position and the image forming area A is described. FIG. 4 is a perspective view of the image forming unit 2 of the first embodiment. FIG. 5 is a drawing illustrating a driving unit for moving the test pattern forming plate 16.

The width of the test pattern forming plate 16 in the main-scanning direction (a direction indicated by an arrow D in FIG. 4) is equal to or larger than that of the printable area in the main-scanning direction of the inkjet heads 10. The test pattern forming plate 16 is supported by a pair of guide parts 30. When a belt driving motor 7 for driving the conveyor belt 14 rotates, the rotation is transmitted via a driving belt 8 to a driving gear 20 and rotates the belt driving roller 12 that is coaxial with the driving gear 20. Then, the belt driving roller 12 turns the conveyor belt 14 the internal surface of which is in contact with the belt driving roller 12.

The conveyor belt 14 rotates a belt driven roller 13. The rotational motion is transmitted as a driving force via a belt driven gear 31 that is coaxial with the belt driven roller 13, an intermediate gear 32, and a drive transmission gear 33 to the test pattern forming plate 16. The belt driven gear 31, the intermediate gear 32, and the drive transmission gear 33 forms a drive transmission unit for transmitting the rotational motion (or a driving force) of the belt driven roller 13 to the test pattern forming plate 16. On the under surface of the test pattern forming plate 16, a comb-like rack 16*a* is formed to convert the rotational motion of the drive transmission gear 33 into a linear motion. Also, a first stopper 34 and a second stopper 35 are provided at corresponding ends of the rack 16*a*.

When the conveyor belt 14 is turned in a direction opposite to that it is turned to convey the paper sheet P, the belt driven roller 13 and the belt driven gear 31 are rotated. The rotation of the belt driven gear 31 is transmitted via the intermediate gear 32 to the drive transmission gear 33 in contact with the rack 16*a* of the test pattern forming plate 16. The rotational motion is converted by the rack 16*a* into a linear motion which in turn moves the test pattern forming plate 16. The test pattern forming plate 16 stops when the first stopper 34 comes into contact with the drive transmission gear 33. When the conveyor belt 14 is turned in the same direction as that it is turned to convey the paper sheet P, the test pattern forming plate 16 is moved from the image forming area A to the test pattern forming plate home position. The test pattern forming plate 16 stops when the second stopper 35 comes into contact with the drive transmission gear 33. A torque limiter is attached to the drive transmission gear 33 so that the drive transmission gear 33 idles when the first stopper 34 or the second stopper 35 comes into contact with it.

Thus, in the first embodiment, the test pattern forming plate 16 is moved by using the conveyor belt 14 as a driving source. This configuration eliminates the need to add a dedicated driving source such as a motor to move the test pattern forming plate 16.

Next, the relationship between the width of the printable area of the inkjet heads 10 and the width of the test pattern forming plate 16 is discussed.

Figure 6:
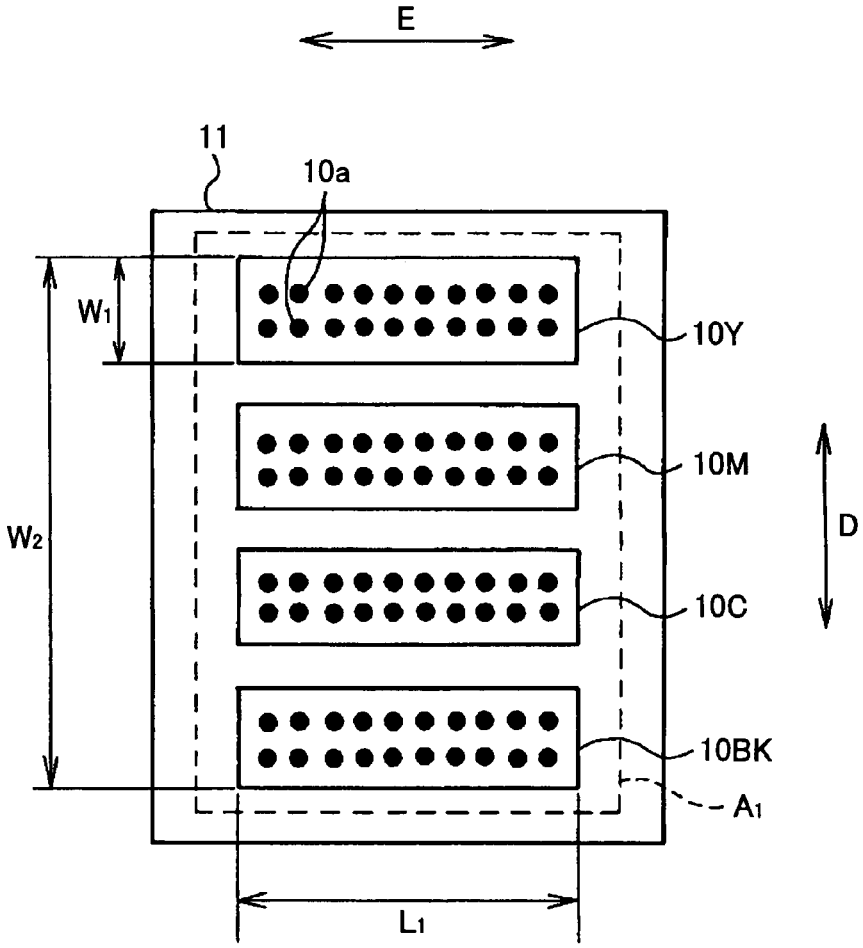
FIG. 6 is a drawing illustrating the under surface of a carriage.

FIG. 6 is a drawing illustrating the under surface of the carriage 11. As shown in FIG. 6, the carriage 11 includes the inkjet heads 10 corresponding to Y, M, C, and Bk colors. Each of the inkjet heads 10 has inkjet nozzles 10*a* for jetting ink on its under surface (nozzle surface).

In an image forming test, a test pattern is formed using all of the inkjet nozzles 10*a* of each of the inkjet heads 10 to examine landing positions of ink droplets jetted from all of the inkjet nozzles 10*a*. Therefore, the width of the test pattern forming plate 16 in the main-scanning direction (a direction indicated by an arrow D in FIG. 6) is preferably larger than the width in the main-scanning direction of an image that any one of the inkjet heads 10 can form by jetting ink droplets once. Also, the length of the test pattern forming plate 16 in the recording medium conveying direction (a direction indicated by an arrow E in FIG. 6) is preferably larger than the length in the recording medium conveying direction of an image that any one of the inkjet heads 10 can form by jetting ink droplets once. In other words, the width in the main-scanning direction of the test pattern forming plate 16 is preferably larger than a width W1 shown in FIG. 6 and the length in the recording medium conveying direction is preferably larger than a length L1 shown in FIG. 6. The test pattern forming plate 16 with the above dimensions can receive all ink droplets jetted at once from all of the inkjet nozzles 10*a* of any one of the inkjet heads 10.

The width in the main-scanning direction of the test pattern forming plate 16 may be made larger than a width W2 shown in FIG. 6. When the width is larger than the width W2, the test pattern forming plate 16 can receive all ink droplets jetted at once from all of the inkjet nozzles 10*a* of all of the inkjet heads 10. More preferably, the test pattern forming plate 16 is larger than an area A1 indicated by a dotted line in FIG. 6.

When the size is larger than the area A1, the test pattern forming plate 16 can more reliably receive all ink droplets jetted at once from all of the inkjet nozzles 10*a* of all of the inkjet heads 10.

The area A1 corresponds to the image forming area A shown in FIG. 2.

In the printer 1, the width in the main-scanning direction of the test pattern forming plate 16 is preferably smaller than that of the conveyor belt 14. Compared with a configuration disclosed in patent document 1 where a test pattern forming area is provided on the recording medium conveying belt, this configuration makes it possible to reduce the width of an image forming apparatus.

As shown in FIG. 4, the width in the main-scanning direction of the test pattern forming plate 16 of the first embodiment is larger than the maximum width of the paper sheet P. In other words, the test pattern forming plate 16 covers the entire printable area of the carriage 11 and therefore enables detection of landing positions of ink droplets throughout the printable area. In short, the width of the test pattern forming plate 16 is preferably larger than the maximum width of the paper sheet P and smaller than the width of the conveyor belt 14.

Next, a water-repellent layer formed on the test pattern forming plate 16 is described. The water-repellent layer may be formed by vacuum deposition or by applying a water repellent dissolved in a solvent. In a vacuum deposition process, for example, a vacuum chamber is evacuated by a vacuum pump to a predetermined degree of vacuum and a water repellent is introduced into the vacuum chamber and vaporized at 400° C. The vacuum atmosphere is conditioned and an RF glow discharge is caused in the vacuum atmosphere by supplying electricity to discharging electrodes from a high-frequency power source. An orifice surface of the test pattern forming plate 16 is surface-treated in the resulting plasma atmosphere to form a water-repellent layer. Depending on the type of the water repellent and the degree of vacuum, a water-repellent layer may be formed at a low temperature, for example, between ambient temperature and 200° C.

As another example, a water-repellent layer may be formed by applying a water repellent dissolved in an organic solvent on the test pattern forming plate 16 by, for example, a wire bar or a doctor blade. Further, a water-repellent layer may be formed by spin coating, spraying, or dip coating.

As a water repellent, for example, an organic compound having a fluorine atom(s), especially, an organic compound having a fluoroalkyl group(s), or an organosilicon compound having a dimethylsiloxane backbone(s) may be used.

As an organic compound having a fluorine atom(s), fluoroalkylsilane, alkane having a fluoroalkyl group(s), carboxylic acid having a fluoroalkyl group(s), alcohol having a fluoroalkyl group(s), or amine having a fluoroalkyl group(s) is preferable. Examples of fluoroalkylsilane include heptadecafluoro-1,1,2,2-tetrahydrodecyltrimethoxysilane and heptadecafluoro-1,1,2,2-tetrahydrotrichlorosilane. Examples of alkane having a fluoroalkyl group(s) include octafluorocyclobutane, perfluoromethylcyclohexane, perfluoro-n-hexane, perfluoro-n-heptane, tetradecafluoro-2-methylpentane, perfluorododecane, and perfluoroeicosane. Examples of carboxylic acid having a fluoroalkyl group(s) include perfluorodecanoic acid and perfluorooctane acid. Examples of alcohol having a fluoroalkyl group(s) include 3,3,4,4,5,5,5-heptafluoro-2-pentanol. Examples of amine having a fluoroalkyl group(s) include heptadecafluoro-1,1,2,2-tetrahydrodecylamine. Examples of an organosilicon compound having a dimethylsiloxane backbone(s) include α,w-bis(3-aminopropyl)polydimethylsiloxane, α,w-bis(3-glycidoxypropyl)polydimethylsiloxane, and α,w-bis(vinyl)polydimethylsiloxane.

Also, as a water repellent, an organic compound having a silicon atom(s), especially, an organic compound having an alkylsiloxane group(s) may be used.

Examples of an organic compound having an alkylsiloxane group(s) include an alkylsiloxane-containing epoxy resin having two or more alkylsiloxane groups and aliphatic epoxy groups in its constituent molecule. More specifically, a high polymer including structural units represented by chemical formulas (a) and (b) below may be used.

(a)

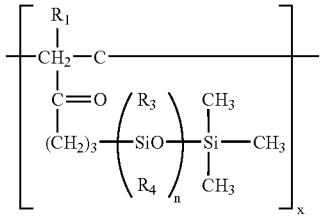

(b)

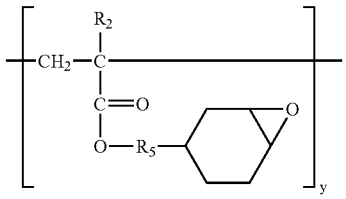

In the above chemical formulas, x, y, and n are integers in their respective ranges: x=1-50, y=2-100, n=2-100

$R_1$ and $R_2$ are, independently, —H or —$CH_3$ $R_3$ and $R_4$ are, independently, —$CH_3$ or

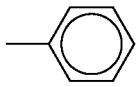

$R_5$ is —$CH_2$—, —$CH_2CH_2$—, or

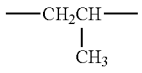

A chemical compound as described above also functions as a binder when used together with another water-repellent compound. In other words, a chemical compound as described above improves the coating property and drying property of a water-repellent composition.

The thickness of a water-repellent layer is preferably 5 μm or smaller and more preferably 2 μm or smaller. If the thickness is larger than 5 μm, much time is required to dry the water-repellent layer and therefore productivity may be reduced. Also, with a thickness of larger than 5 μm, the mechanical durability of the water-repellent layer may be reduced and the water-repellent layer may be peeled off when wiped by the cleaning roller 15.

Second Embodiment

An exemplary image forming unit including a recording medium conveyor and a separate test pattern forming part according to a second embodiment is described below.

Figure 7:
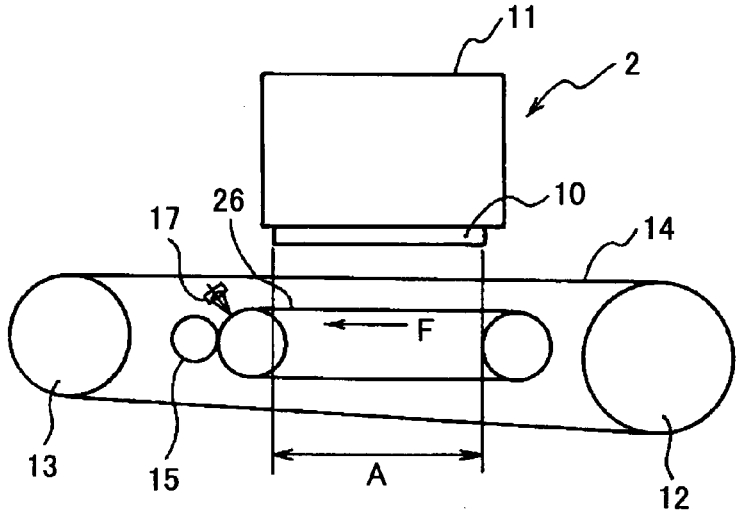
FIG. 7 is a side view of an exemplary image forming unit according to a second embodiment.
Figure 8:
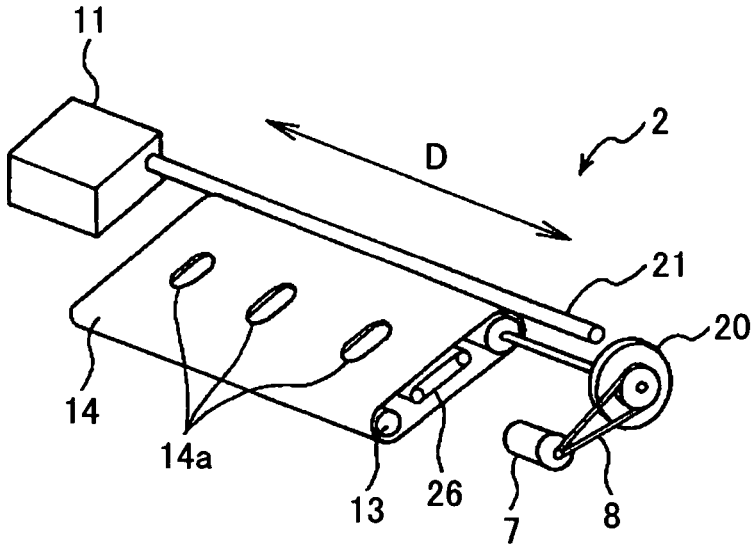
FIG. 8 is a perspective view of the exemplary image forming unit according to the second embodiment.

FIG. 7 is a side view of the image forming unit 2 according to the second embodiment. FIG. 8 is a perspective view of the image forming unit 2 according to the second embodiment.

As shown in FIG. 7, the image forming unit 2 of the second embodiment includes a test pattern forming belt 26 (test pattern forming part). The test pattern forming belt 26 is positioned in a space surrounded by the conveyor belt 14 and corresponding to the image forming area A.

The conveyor belt 14, as shown in FIG. 8, has openings 14*a* that allow ink droplets to pass therethrough and to reach the test pattern forming belt 26 when the paper sheet P is not being conveyed. When a test pattern is formed, the conveyor belt 14 stops at a position where the openings 14*a* face the inkjet heads 10 in the image forming area A. Ink droplets jetted from the inkjet heads 10 pass through the openings 14*a* and form a test pattern on the test pattern forming belt 26. After a test pattern is formed, the test pattern forming belt 26 turns in a direction indicated by an arrow F shown in FIG. 7. The test pattern on the test pattern forming belt 26 is detected by the test pattern detection unit 17. After being detected by the test pattern detection unit 17, the test pattern is wiped off by the cleaning roller 15.

The openings 14*a* are arranged in the main-scanning direction (a direction indicated by the arrow D in FIG. 8). This configuration makes it possible to form multiple test patterns on the test pattern forming belt 26 in positions within the image forming area A and thereby to detect and correct positional deviation of ink droplets throughout the printable area of the carriage 11. Based on the detection results, the control unit 90 corrects the positional deviation of ink droplets.

[Variation]

A variation of the second embodiment is described below.

Figure 9:
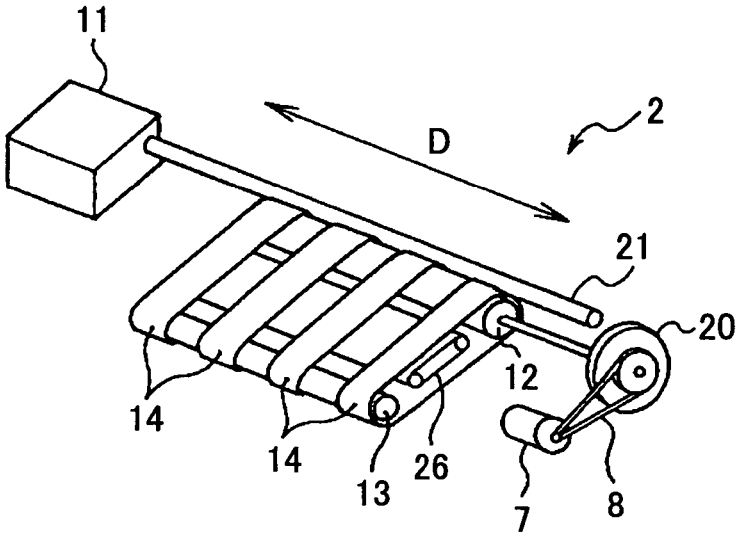
FIG. 9 is a perspective view of a variation of the exemplary image forming unit according to the second embodiment.

FIG. 9 is a perspective view of a variation of the image forming unit 2 according to the second embodiment. As shown in FIG. 9, the conveyor belt 14 of a variation of the image forming unit 2 according to the second embodiment is composed of multiple belt parts. The belt parts are arranged parallel to the recording medium conveying direction at certain intervals. A test pattern is formed by jetting ink droplets from the inkjet heads 10 through the gaps between the belt parts onto the test pattern forming belt 26 positioned in a space surrounded by the conveyor belt 14.

Third Embodiment

An exemplary image forming unit including a recording medium conveyor and a separate test pattern forming part according to a third embodiment is described below.

Figure 10:
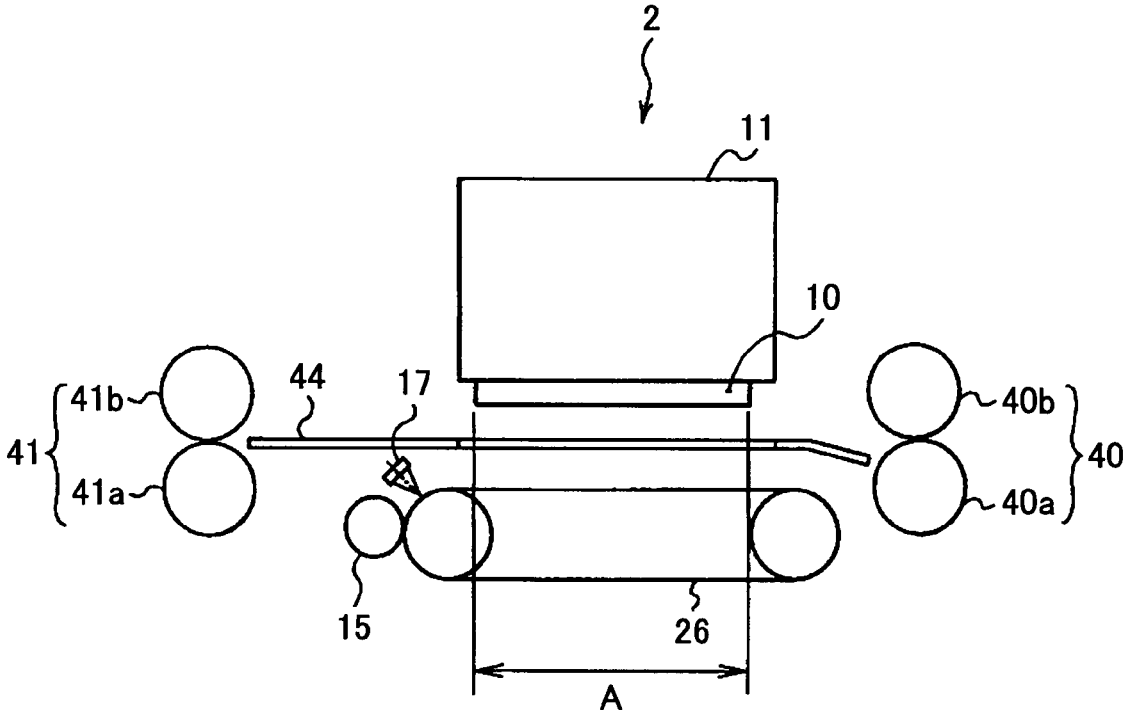
FIG. 10 is a side view of an exemplary image forming unit according to a third embodiment.
Figure 11:
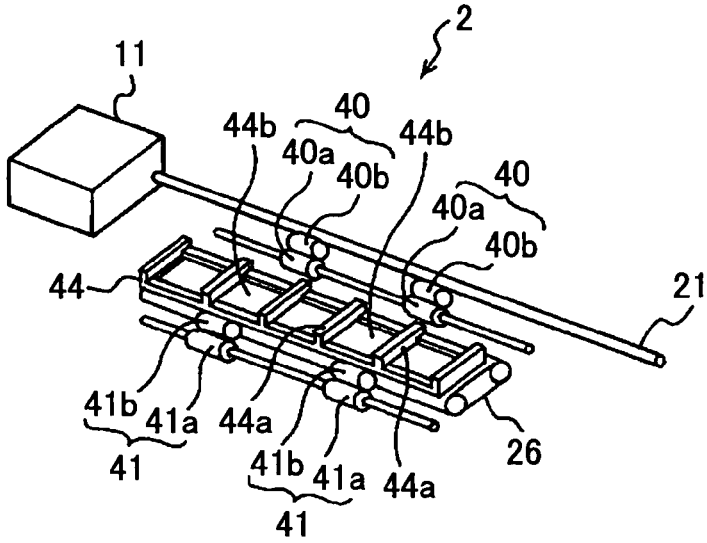
FIG. 11 is a perspective view of the exemplary image forming unit according to the third embodiment.

FIG. 10 is a side view of the image forming unit 2 according to the third embodiment. FIG. 11 is a perspective view of the image forming unit 2 according to the third embodiment.

The image forming unit 2 of the third embodiment includes upstream conveying rollers 40 composed of an upstream driving roller 40*a* and an upstream driven roller 40*b*, and downstream conveying rollers 41 composed of a downstream driving roller 41*a* and a downstream driven roller 41*b*. The upstream conveying rollers 40 are positioned upstream of the image forming area A in the recording medium conveying direction and the downstream conveying rollers 41 are positioned downstream of the image forming area A in the recording medium conveying direction. The upstream conveying rollers 40 and the downstream conveying rollers 41 are used as conveying force applying parts that feed the paper sheet P. The paper sheet P is sandwiched between the driving and driven rollers and is fed as the driving and driven rollers rotate. The image forming unit 2 of the third embodiment also includes a paper guide 44 (recording medium guide) between the upstream conveying rollers 40 and the downstream conveying rollers 41. The paper guide 44 supports and guides the paper sheet P. In the third embodiment, the upstream conveying rollers 40, the downstream conveying rollers 41, and the paper guide 44 constitute a recording medium conveyor.

The image forming unit 2 of the third embodiment further includes the test pattern forming belt 26 positioned under the paper guide 44 in an area corresponding to the image forming area A.

As shown in FIG. 11, the paper guide 44 is composed of guide ribs 44*a*. Openings 44*b* are formed between the guide ribs 44*a* so that ink droplets can pass through the paper guide 44 when the paper sheet P is not being conveyed. A test pattern is formed by jetting ink droplets from the inkjet heads 10 through the openings 44*b* onto the test pattern forming belt 26 positioned below the paper guide 44.

An exemplary process, in the printer 1, of correcting positional deviation of ink droplets based on a test pattern detected by the test pattern detection unit 17 is described below.

Figure 12:
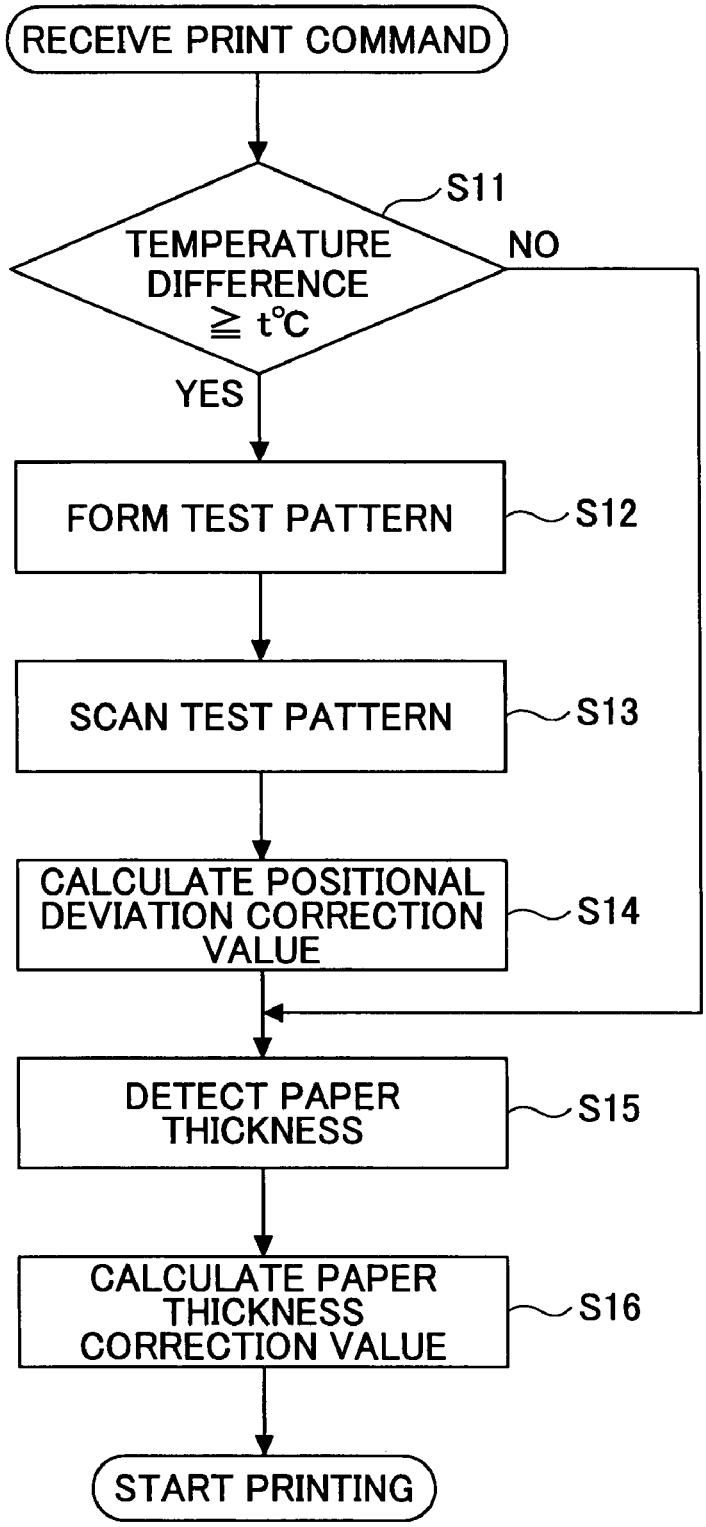
FIG. 12 is a flowchart showing an exemplary process of correcting positional deviation of ink droplets.
Figure 13:
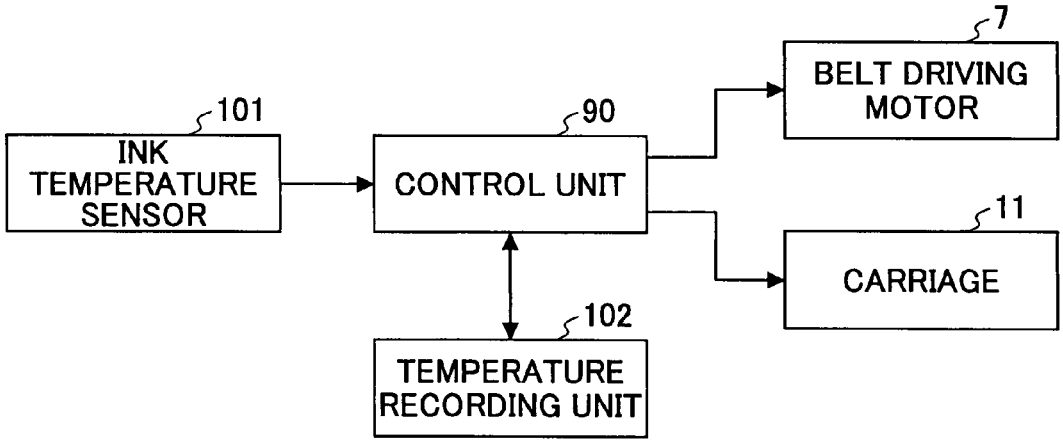
FIG. 13 is a block diagram illustrating a system where a positional deviation correction process is started based on a detection result from an ink temperature sensor.

FIG. 12 is a flowchart showing an exemplary process of correcting positional deviation of ink droplets. In this example, an image forming test is performed if temperature change of ink is larger than a predetermined value. FIG. 13 is a block diagram illustrating a system where a positional deviation correction process is started based on a detection result from the ink temperature sensor 101.

As shown in FIG. 13, an ink temperature detected by the ink temperature sensor 101 is sent via the control unit 90 to a temperature recording unit 102 where the detected ink temperature is recorded. The control unit 90 also retrieves a previous ink temperature from the temperature recording unit 102 and compares the detected ink temperature with the previous ink temperature. It is known that the viscosity of ink may change depending on its temperature. Even when the same pressure is applied by an actuator to ink in the inkjet heads 10 to jet ink droplets from the inkjet nozzles 10*a*, the initial velocity of the jetted ink droplets may change depending on the viscosity of the ink. The change in initial velocity of ink droplets may result in change in landing positions of the ink droplets. For this reason, the control unit 90 (or the image forming test control unit) of this embodiment is configured to compare a detected ink temperature and a previous ink temperature and to determine whether to perform an image forming test based on the result of comparison.

When a print command or an adjustment command is received, the control unit 90 causes the ink temperature sensor 101 to detect the temperature of ink. In FIG. 12, it is assumed that a print command is received. As shown in FIG. 12, the control unit 90 compares the detected ink temperature with a previous ink temperature recorded in the temperature recording unit 102 (S11). If the difference between the detected ink temperature and the previous ink temperature is equal to or larger than a predetermined value t[° C.] (Yes in step S11), the control unit 90 performs an image forming test. In the image forming test, a test pattern for detecting positional deviation of ink droplets is formed on the test pattern forming plate 16 (S12). The test pattern detection unit 17 scans the test pattern (S13) and the control unit 90 calculates a positional deviation correction value based on the scanned test pattern (S14). The positional deviation correction value represents the difference between a desirable position of a test pattern and the actual position of the test pattern formed on the test pattern forming plate 16. The control unit 90 (or the corrective action control unit) performs necessary corrective actions based on the positional deviation correction value so that the actual position of the test pattern matches the desirable position.

Through a correction process as described above, the printer 1 of this embodiment maintains excellent image quality.

After the positional deviation correction value is calculated in step S14 or if the difference between the detected ink temperature and the previous ink temperature is lower than the predetermined value t [° C.] in step S11, the control unit 90 feeds the paper sheet P from the paper feed tray 50 and causes the paper thickness sensor 501 to detect the thickness of the paper sheet P (S15). Then, the control unit 90 calculates a paper thickness correction value based on the detected thickness of the paper sheet P (S16) and further performs corrective actions taking into account the paper thickness correction value.

Meanwhile, the image forming unit 2 of the printer 1 includes a linear scale (not shown) for determining the position of the carriage 11. The linear scale is a strip-shaped film having a black and white pattern printed thereon at a certain resolution. The linear scale covers a range within which the carriage 11 can move and is fixed to the body of the printer 1 in parallel with the guide rod 21. A position detection sensor (not shown) mounted to the carriage 11 detects the black and white pattern of the linear scale and thereby determines the position of the carriage 11. Ink droplets are jetted from the inkjet heads 10 taking into account the position of the carriage 11 and the relative positions of the inkjet heads 10.

In the exemplary process shown in FIG. 12, the paper thickness correction value is calculated based on the thickness of the paper sheet P detected by the paper thickness sensor 501. Instead, the paper thickness correction value may be calculated based on the thickness of the paper sheet P input via a recording medium thickness inputting unit. For example, an operations panel (not shown) of the printer 1 may be used as the recording medium thickness inputting unit. If the printer 1 includes multiple paper feed trays 50 that can hold different types of papers, the recording medium thickness inputting unit may be configured to allow specification of the thickness of paper for each of the paper feed trays 50. In this case, the printer 1 may be configured to obtain the paper thickness correction value when any one of the paper feed trays 50 is selected.

As another example, an ink viscosity sensor (ink viscosity detection unit) for detecting the viscosity of ink in an ink container and a viscosity recording unit may be provided instead of the ink temperature sensor 101 and the temperature recording unit 102 shown in FIG. 13. With this configuration, the control unit 90 receives the ink viscosity detected by the ink viscosity sensor, retrieves previous ink viscosity from the viscosity recording unit, and compares the detected ink viscosity with the previous ink viscosity. If the difference between the detected ink viscosity and the previous ink viscosity is equal to or larger than a predetermined value, the control unit 90 performs an image forming test. Viscosity of ink may be obtained based on the change in the load of an agitator motor for agitating ink in an ink container which load of the agitator motor increases as the ink viscosity increases. Also, viscosity of ink may be obtained based on the change in the load of an ink supplying pump for supplying ink from the ink cartridge 134 to the second ink container in the inkjet head 10 which load of the ink supplying pump increases as the ink viscosity increases.

Factors other than changes in ink temperature and ink viscosity may also be used to trigger an image forming test. For example, the printer 1 may include an inkjet counter for counting the number of times ink droplets are jetted from an inkjet head and be configured to perform an image forming test when the number of times ink droplets are jetted reaches a predetermined value. After repeated use, performance of an inkjet head may be degraded. For example, pressure that an actuator can generate with a certain voltage may change or inkjet nozzles may be deformed over time. Under such conditions, if image forming is performed using the same parameters (for example, the moving speed of the carriage 11 and the voltage applied to the actuator) as those used in the initial conditions, the landing positions of ink droplets may deviate from desired positions. Such a problem can be prevented by performing an image forming test and thereby correcting the positional deviation of ink droplets when the number of times ink droplets are jetted reaches a predetermined value.

Also, the printer 1 may be configured to perform an image forming test when the number of printed pages, which is the total number of paper sheets P on which images are formed, reaches a predetermined value. This configuration also prevents positional deviation of ink droplets caused by degradation over time of inkjet heads.

Further, the printer 1 may be configured to perform an image forming test after it is unused for a predetermined period of time. If a printer is unused for a long time, for example, pressure that an actuator can generate with a certain voltage may change and the viscosity of ink in an ink container may also change. Under such conditions, if image forming is performed using the same parameters (for example, the moving speed of the carriage 11 and the voltage applied to the actuator) as those used in the initial conditions, the landing positions of ink droplets may deviate from desired positions. Such a problem can be prevented by performing an image forming test and thereby correcting the positional deviation of ink droplets after the printer 1 is unused for a predetermined period of time.

An exemplary ink droplet travel distance correction process is described below. In the exemplary ink droplet travel distance correction process, positional deviation of ink droplets are corrected based on the difference between the travel distance of ink droplets jetted onto the test pattern forming plate 16 to form a test pattern and the travel distance of ink droplets jetted onto the paper sheet P to form an image.

Figure 14:
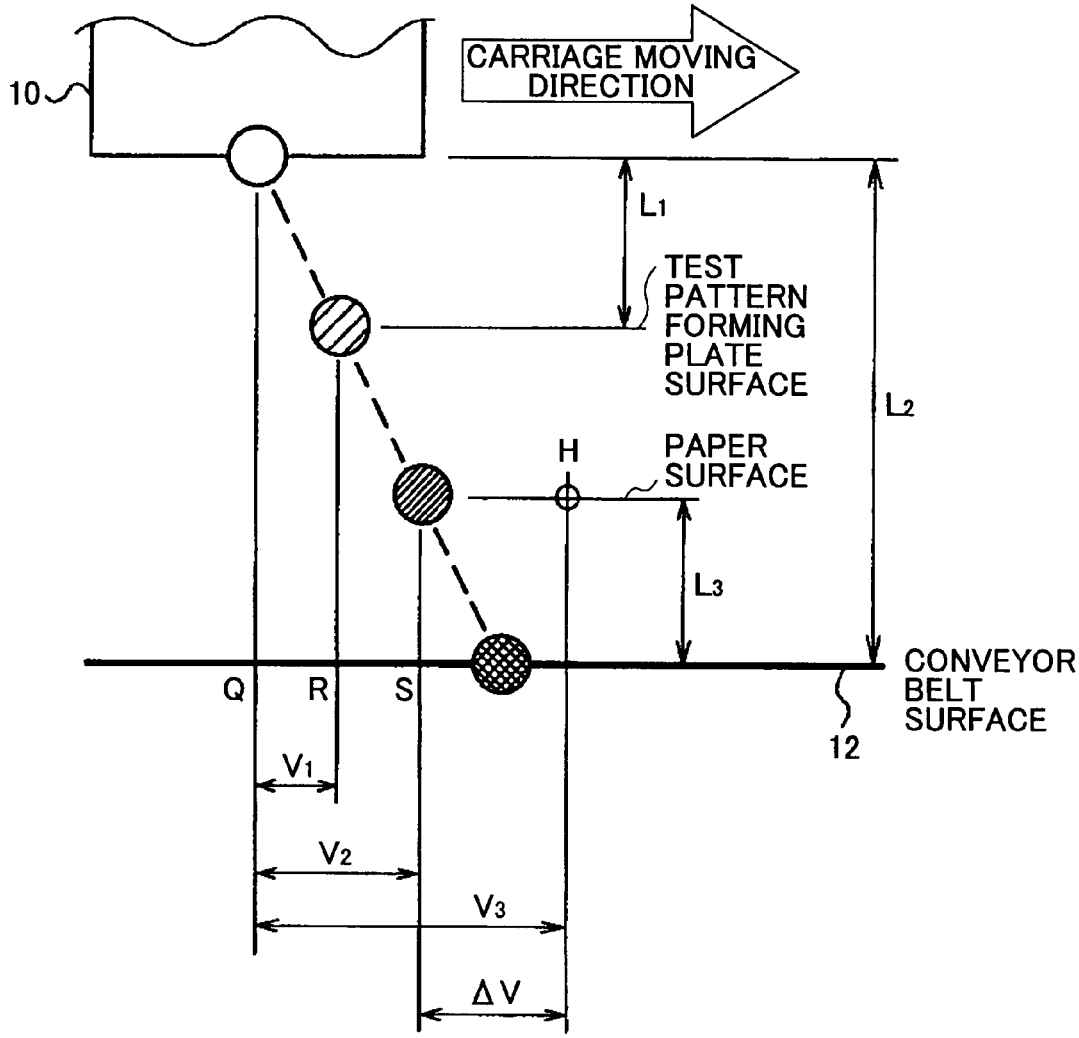
FIG. 14 is a drawing used to describe travel distances of ink droplets.

FIG. 14 is a drawing used to describe travel distances of ink droplets. In FIG. 14, L1 indicates the distance between the nozzle surface of the inkjet head 10 and the upper surface of the test pattern forming plate 16, L2 indicates the distance between the nozzle surface and the upper surface of the conveyor belt 14, and L3 indicates the thickness of the paper sheet P. Accordingly, the distance between the nozzle surface and the surface of the paper sheet P is L2-L3.

In the exemplary ink droplet travel distance correction process, a travel distance V1, which is the distance between an ink-jetting position Q at which an ink droplet is jetted by an inkjet nozzle and a landing position R of the ink droplet on the test pattern forming plate 16, is obtained based on a test pattern formed. Then, based on the travel distance V1, a travel distance V2 between the ink-jetting position Q at which an ink droplet is jetted toward the paper sheet P and a landing position S of the ink droplet on the paper sheet P is calculated. In this embodiment, the travel distance V2 is calculated by formula (1) below.

$$V2=(L2-L3)\times V1\div L1 \quad (1)$$

Next, a positional deviation correction value is calculated based on the travel distance V2 and corrective actions are performed based on the positional deviation correction value.

In FIG. 14, H indicates a target landing position on the paper sheet P where an ink droplet is to be aimed. A positional deviation correction value ΔV is calculated as the difference between a target travel distance V3 from the ink-jetting position Q to the target landing position H and the travel distance V2 (V3−V2).

When ΔV≈0, an image is formed on the paper sheet P using the same parameters as those used to form the test pattern without performing corrective actions.

When ΔV>0, corrective actions, such as increasing the moving speed of the carriage 11, increasing the distance L2, and delaying the timing of jetting ink droplets, are performed. When ΔV<0, corrective actions, such as decreasing the moving speed of the carriage 11, decreasing the distance L2, and hastening the timing of jetting ink droplets, are performed.

The travel distance V2 is adjusted by the above corrective actions so that ΔV becomes equal or close to 0. Thus, landing positions of ink droplets on the paper sheet P are optimized to form a high-quality image.

Further, a paper thickness correction value may be calculated based on the travel distance V1 and corrective actions may be performed based on the paper thickness correction value.

A paper thickness correction value is a positional deviation correction value ΔV that is recalculated by obtaining a travel distance V2 using a detected or input thickness of the paper sheet P as L3 in formula (1) and subtracting the obtained travel distance V2 from the target travel distance V3. Assuming that the current positional deviation correction value ΔV is equal or close to 0 (ΔV≈0), if a detected or input thickness of the paper sheet P is larger than the current thickness of the paper sheet P, the recalculated positional deviation correction value ΔV becomes smaller than 0 (ΔV<0). In this case, corrective actions, such as decreasing the moving speed of the carriage 11, decreasing the distance L2, and hastening the timing of jetting ink droplets, are performed. On the other hand, if a detected or input thickness of the paper sheet P is smaller than the current thickness of the paper sheet P, the recalculated positional deviation correction value ΔV becomes larger than 0 (ΔV>0). In this case, corrective actions, such as increasing the moving speed of the carriage 11, increasing the distance L2, and delaying the timing of jetting ink droplets, are performed.

The printer 1 may include a distance adjusting unit for moving the carriage 11 in a vertical direction and thereby adjusting the distance between the inkjet heads 10 and the paper sheet P. In this case, corrective actions may be performed each time when the carriage 11 is moved in a vertical direction. When the carriage 11 is moved upward or downward, the distance L2 between the nozzle surfaces of the inkjet heads 10 and the upper surface of the conveyor belt 14 changes. By performing corrective actions according to the change in the distance L2, image quality can be maintained even when the carriage 11 is moved in a vertical direction.

An exemplary process of detecting inkjet problems through an image forming test and performing head maintenance according to the detection results is described below.

Figure 15:
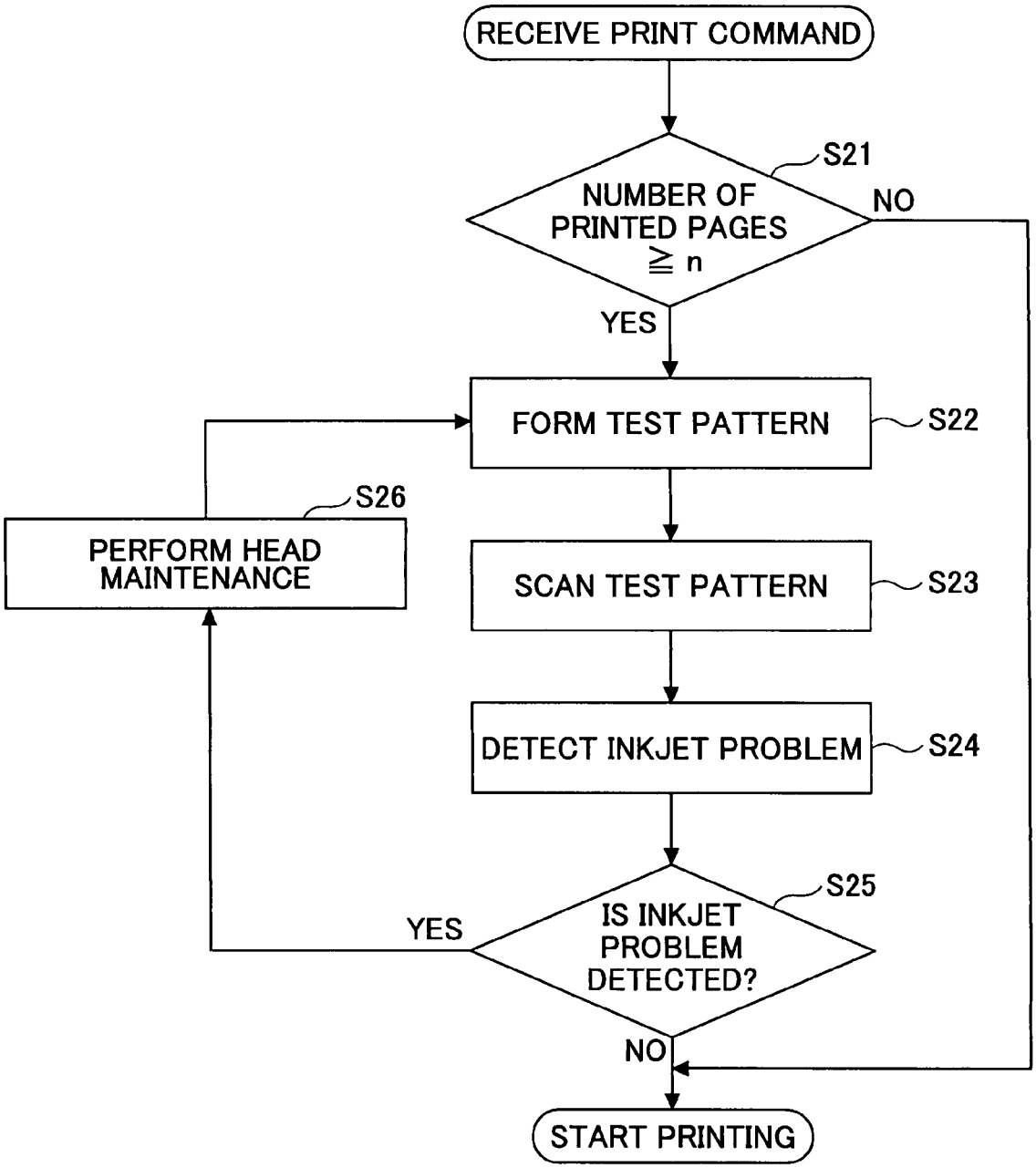
FIG. 15 is a flowchart illustrating an exemplary process of detecting inkjet problems and performing head maintenance.

FIG. 15 is a flowchart illustrating an exemplary process of detecting inkjet problems and performing head maintenance. In this example, an image forming test is performed when the number of printed pages reaches a predetermined value. When a print command or an adjustment command is received, the control unit 90 determines whether the number of printed pages has reached a predetermined value n (S21). In FIG. 15, it is assumed that a print command is received. If the number of printed pages is equal to or larger than the predetermined value n (Yes in step S21), the control unit 90 (or the image forming test control unit) performs an image forming test. In the image forming test, a test pattern for detecting inkjet problems is formed on the test pattern forming plate 16 (S22). The test pattern detection unit 17 scans the test pattern (S23) and an inkjet problem detection unit of the control unit 90 examines the scanned test pattern (S24) to determine whether inkjet problems exist (S25). Inkjet problems include, for example, positional deviation of ink droplets caused by a skewed inkjet angle ("inkjet angle" in this case means an angle at which ink is jetted from an inkjet nozzle) and spots left blank because of ink-jetting failure ("ink-jetting failure" in this case means that ink is not jetted from an inkjet nozzle because of a problem). When an inkjet problem is detected (Yes in step S25), the control unit 90 (or the inkjet problem detection unit) performs head maintenance (S26). After the head maintenance, the control unit 90 performs an image forming test again. More specifically, the control unit 90 repeats steps S22 through S26 until no inkjet problem is detected in step S25. If no inkjet problem is detected (No in step S25), the control unit 90 starts printing.

After repeated printing, for example, ink may adhere near the opening of an inkjet nozzle and skew the inkjet angle of the inkjet nozzle, or ink may clog an inkjet nozzle and cause an ink-jetting failure. Such problems can be reduced by performing an image forming test and head maintenance as shown in FIG. 15 each time when the number of printed pages reaches a predetermined value. Head maintenance may include cleaning of nozzle surfaces and suctioning of inkjet nozzles.

Factors other than the number of printed pages may also be used to trigger an image forming test to detect inkjet problems. Such factors include the number of times ink droplets are jetted from an inkjet head and the unused period of time of the printer 1. These factors also indicate increased possibility of inkjet problems such as a skewed inkjet angle and an ink-jetting failure. Therefore, performing an image forming test and head maintenance based on any one of these factors is preferable to prevent degradation of image quality caused by inkjet problems. Also, the temperature and viscosity of ink may be used as factors to trigger an image forming test.

An exemplary process in the printer 1 of correcting an image density error based on a test pattern detected by the test pattern detection unit 17 is described below.

Figure 16:
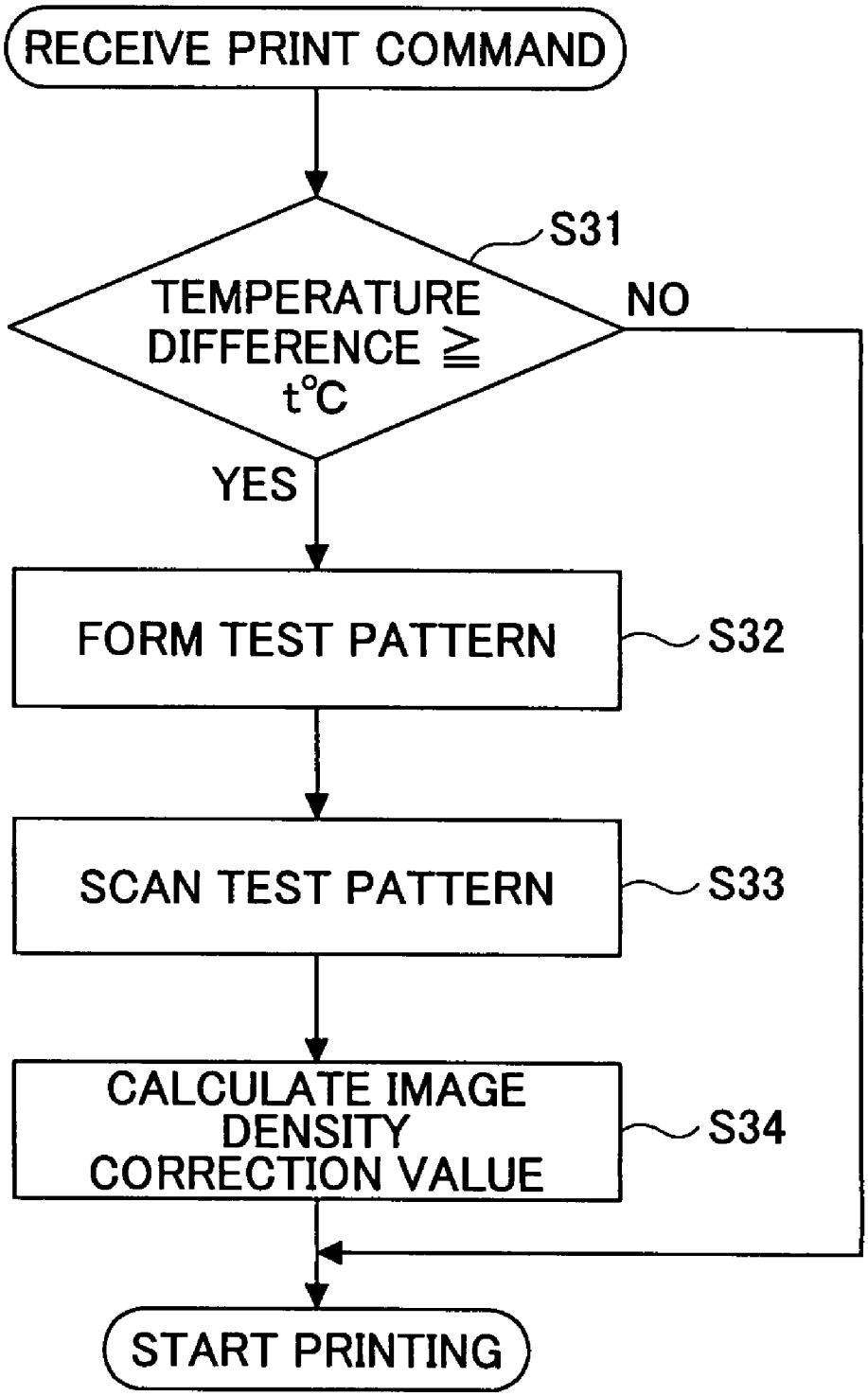
FIG. 16 is a flowchart showing an exemplary process of correcting an image density error.

FIG. 16 is a flowchart showing an exemplary process of correcting an image density error. In this example, an image forming test to detect an image density error is performed if the temperature change of ink is larger than a predetermined value.

When a print command or an adjustment command is received, the control unit 90 causes the ink temperature sensor 101 to detect the temperature of ink. In FIG. 16, it is assumed that a print command is received. As shown in FIG. 16, the control unit 90 compares the detected ink temperature with a previous ink temperature recorded in the temperature recording unit 102 (S31). If the difference between the detected ink temperature and the previous ink temperature is equal to or larger than a predetermined value t [° C.] (Yes in step S31), the control unit 90 (or the image forming test control unit) performs an image forming test. In the image forming test, a test pattern for detecting an image density error is formed on the test pattern forming plate 16 (S32). The test pattern detection unit 17 scans the test pattern (S33) and an ink amount detection unit of the control unit 90 calculates the amount of ink jetted onto the test image forming plate 16 based on the scanned test pattern. A larger amount of ink indicates a higher image density. The control unit 90 (or the ink amount detection unit) calculates an image density correction value based on the calculated amount of ink used to form the test pattern. The image density correction value represents the difference between a desirable amount of ink for forming a test pattern and the actual amount of ink obtained based on the formed test pattern. The control unit 90 (or the corrective action control unit) performs necessary corrective actions based on the image density correction value so that the actual amount of ink matches the desirable amount of ink. For example, as a corrective action, the control unit 90 changes the voltage applied to the actuators of the inkjet heads 10 and thereby adjusts the amount of ink jetted from the inkjet heads 10. Alternatively, the control unit 90 may be configured to correct the image density error by changing the number of ink droplets jetted onto the paper sheet P. Thus, in the exemplary process described above, the amount of ink jetted onto the test image forming plate 16 is calculated and corrective actions are performed as needed to maintain a desirable image density and thereby to maintain image quality. Factors, such as the viscosity of ink and the load of an ink supplying pump, other than changes in ink temperature may also be used to trigger an image forming test.

Also, an image forming test to detect an image density error may be performed at a timing when the number of times ink droplets are jetted, the number of printed pages, or the unused period of time of the printer 1 reaches a predetermined value. After repeated use, performance of inkjet heads may be degraded. For example, pressure that an actuator of an inkjet head can generate with a certain voltage may change and, as a result, the amount of ink jetted from the inkjet head with the voltage may change. Therefore, it is preferable to perform an image density correction process at the above mentioned timing to prevent change in image density resulting from performance degradation over time of inkjet heads.

Figure 17:
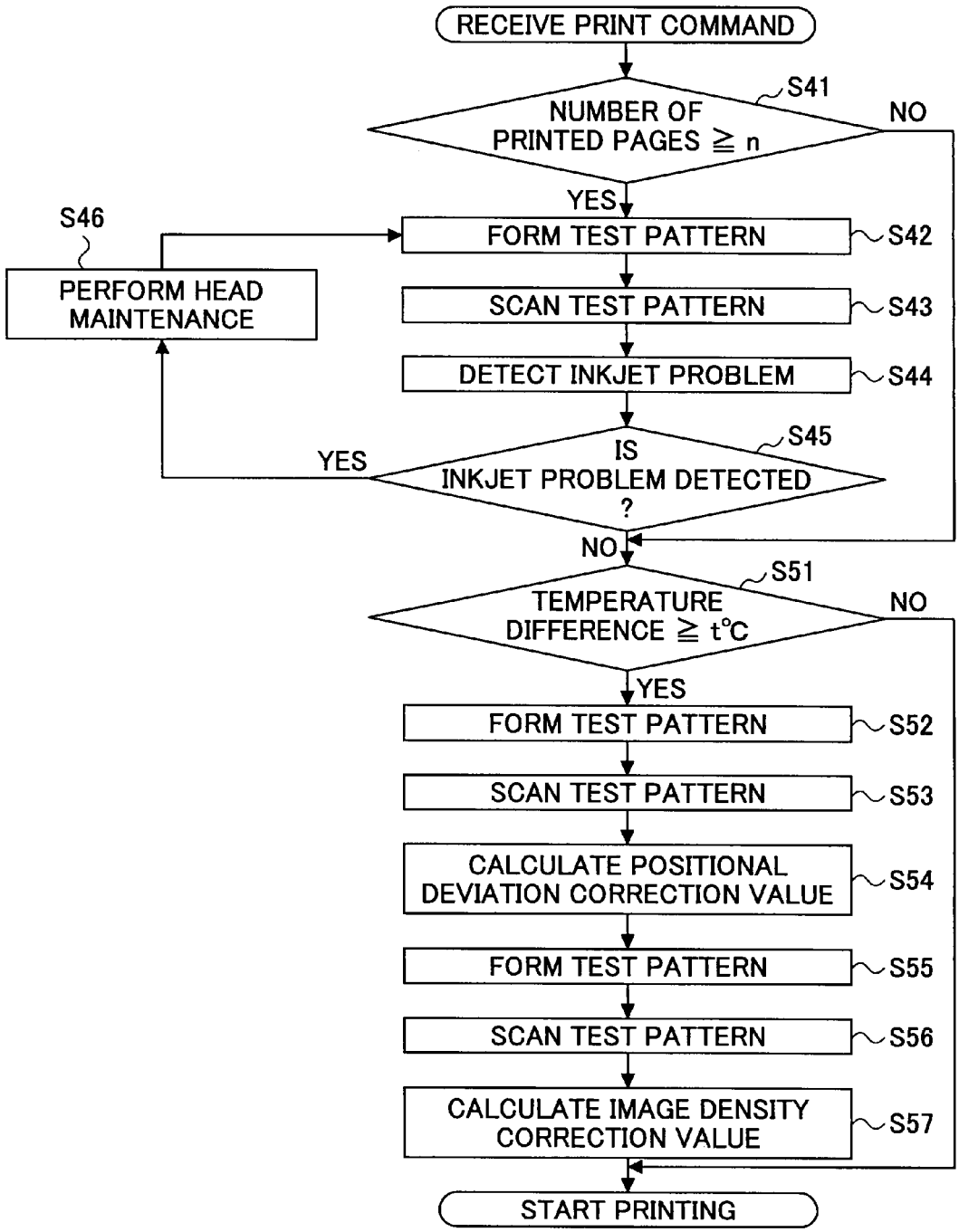
FIG. 17 is a flowchart illustrating a combined process of correcting inkjet problems, positional deviation of ink droplets, and an image density error based on the results of examining test patterns.

FIG. 17 is a flowchart illustrating a combined process of correcting inkjet problems, positional deviation of ink droplets, and an image density error based on the results of examining test patterns. In the exemplary process shown in FIG. 17, inkjet problem correction steps (S41 through S46) are performed if the number of printed pages is equal to or larger than a predetermined value n. After the inkjet problem correction steps, positional deviation correction steps (S51 through S54) are performed if the difference between a detected ink temperature and the previous ink temperature is equal to or larger than a predetermined value t [° C.]. Then, image density correction steps (S55 through S57) are performed following the positional deviation correction steps. In other words, the image density correction steps are performed after inkjet problems and positional deviation of ink droplets are corrected through the inkjet problem correction steps and the positional deviation correction steps. In the positional deviation correction steps and the image density correction steps, a test pattern for detecting positional deviation of ink droplets is formed (S52) and scanned (S53), a positional deviation correction value is calculated based on the scanned test pattern (S54), a test pattern for detecting an image density error is formed (S55) and scanned (S56), and an image density correction value is calculated based on the scanned test pattern (S57).

If the image density correction steps are performed before the positional deviation of ink droplets is corrected, the amount of ink used to form the test pattern for image density error detection may not be correctly detected because dots forming the test pattern may be incorrectly overlapped due to the positional deviation of ink droplets. Therefore, it is preferable to perform the positional deviation correction steps before the image density correction steps to accurately correct an image density error.

Also, to prevent image density change caused by positional deviation of ink droplets, it is preferable to form the test pattern for image density error detection as a monochrome pattern for each inkjet head 10 while moving the carriage 11 in the outbound direction ("outbound direction" indicates the moving direction of the carriage 11 or the inkjet heads 10 departing from their home position and "inbound direction" indicates the moving direction of the carriage 11 or the inkjet heads 10 returning to their home position).

Next, test patterns used in the above correction processes are described.

Figure 18:
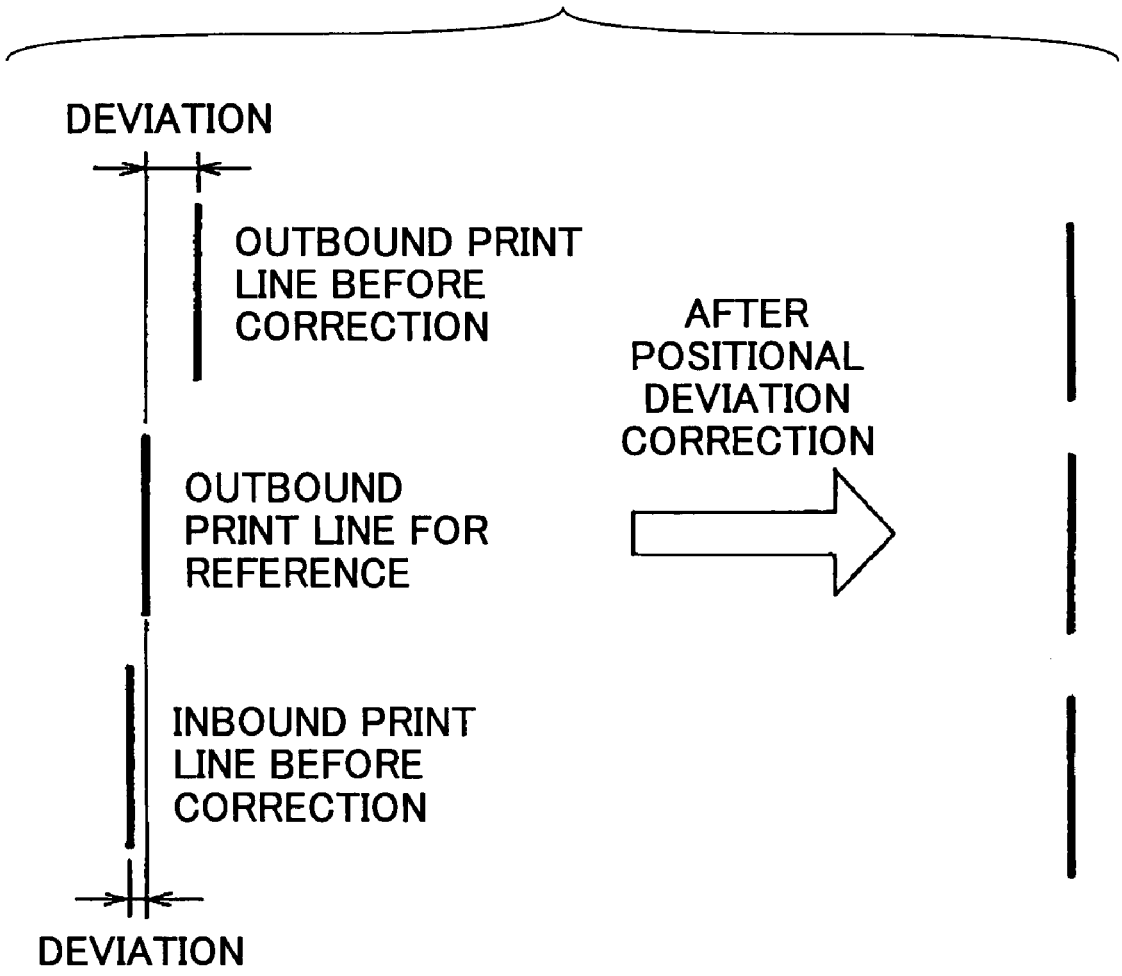
FIG. 18 is a drawing illustrating an exemplary test pattern used in a positional deviation correction process.

FIG. 18 is a drawing illustrating an exemplary test pattern used in a positional deviation correction process. As a first step to correct positional deviation of ink droplets, landing positions of ink droplets jetted from the inkjet head 10 for black color (hereafter called the black inkjet head 10) moving in the outbound direction are adjusted, for example, by changing the moving speed of the carriage 11 or by changing the vertical position of the carriage 11 and thereby changing the distance between the nozzle surface of the black inkjet head 10 and the upper surface of the conveyor belt 14 (or the paper guide 44). The adjusted landing positions of ink droplets, i.e. a line formed by the black inkjet head 10 moving in the outbound direction (hereafter called an outbound print line) is used as a reference line to adjust the landing positions of ink droplets for other inkjet heads 10. Next, outbound print lines are formed by the other inkjet heads 10 and correction values are calculated with reference to the outbound print line of the black inkjet head 10. Since the moving speed and the vertical position of the carriage 11 are already adjusted to adjust the landing positions of ink droplets from the black inkjet head 10, the landing positions of ink droplets from the other inkjet heads 10 are adjusted by changing the timing to jet ink droplets. Also, landing positions of ink droplets jetted from the inkjet heads 10 in the inbound path may be adjusted in substantially the same manner.

Figure 19:
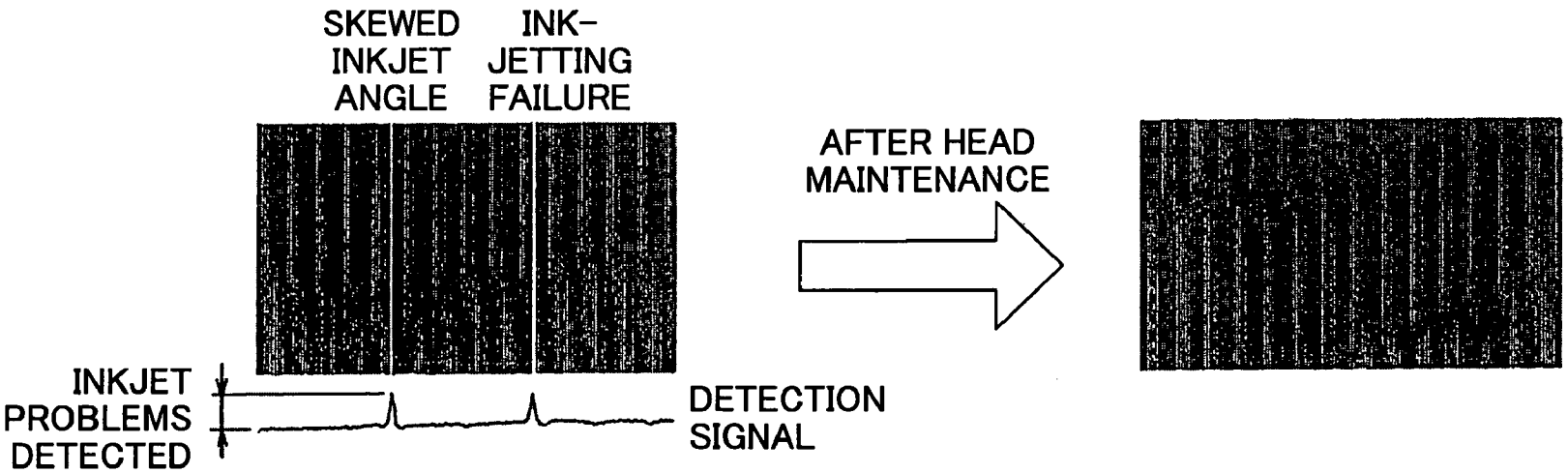
FIG. 19 is a drawing illustrating an exemplary test pattern used in an inkjet problem correction process.

FIG. 19 is a drawing illustrating an exemplary test pattern used in an inkjet problem correction process. As a test pattern for inkjet problem detection, a uniform pattern is formed by jetting ink droplets from all inkjet nozzles of the inkjet head 10 to be tested. Since a water-repellent layer is formed on the test pattern forming plate 16, ink droplets from the inkjet nozzles are isolated from each other and the test pattern is formed as a row of lines arranged at regular intervals. The test pattern detection unit 17 detects the test pattern and generates a detection signal. When the level of the detection signal reaches a threshold, it is identified as an inkjet problem. As shown in FIG. 19, an ink-jetting failure results in a thin, white line in the test pattern, and a skewed inkjet angle results in a thin, white line and a preceding or succeeding dense line.

Figure 20:
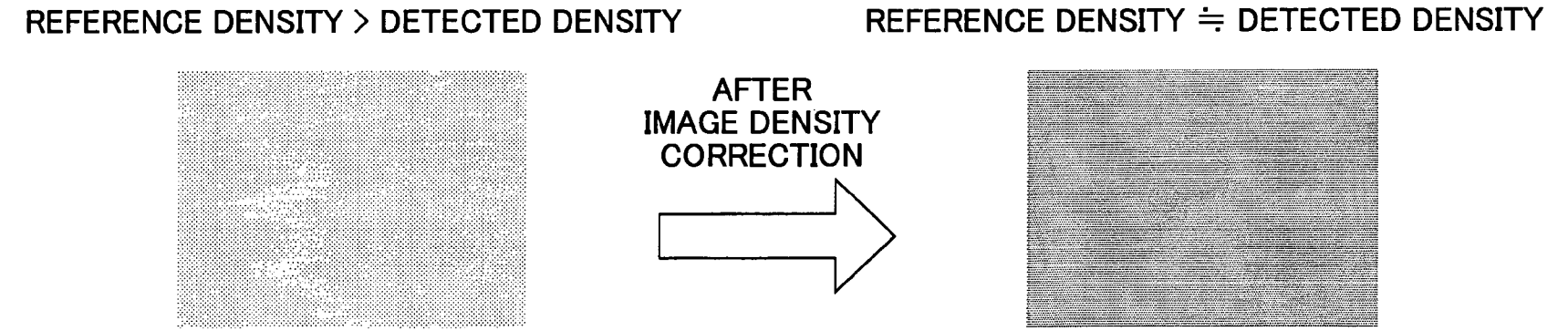
FIG. 20 is a drawing illustrating an exemplary test pattern used in an image density correction process.

FIG. 20 is a drawing illustrating an exemplary test pattern used in an image density correction process. As a test pattern for image density error detection, a halftone image where dots are isolated from each other is formed. The optical density of the formed test pattern is compared with a reference density and if there is a difference between them, corrective actions are performed.

According to an embodiment of the present invention, the image forming unit 2 includes the test pattern forming plate 16 separately from the conveyor belt 14. A test pattern is formed on the test pattern forming plate 16 by jetting ink droplets from the inkjet heads 10 and no ink droplet is jetted onto the paper sheet P or the conveyor belt 14 to form a test pattern. Thus, the image forming unit 2 can perform an image forming test without using the paper sheets P. Also, since no ink droplet is jetted onto the conveyor belt 14, ink does not adhere to the conveyor belt 14 and therefore does not smear the back sides of the paper sheets P.

According to the first embodiment of the present invention, the test pattern forming plate 16 moves into the image forming area A facing the inkjet heads 10 when a test pattern is formed and is positioned outside of the image forming area A when a test pattern is not formed.

The image forming unit 2 of the first embodiment also includes the belt driven gear 31, the intermediate gear 32, and the drive transmission gear 33 as a drive transmission unit for transmitting the motion of the belt driven roller 13 to the test pattern forming plate 16. This configuration eliminates the need to add a dedicated driving source such as a motor to move the test pattern forming plate 16 and thereby makes it possible to reduce production costs.

According to the first embodiment, the thickness dT of the test pattern forming plate 16 is made smaller than the gap dH between the nozzle surfaces of the inkjet heads 10 and the upper surface of the conveyor belt 14 so that the test pattern forming plate 16 can be moved into the image forming area A.

Also, the width and length of the test pattern forming plate 16 are made larger than those of an image that can be formed by jetting ink droplets once from any one of the inkjet heads 10. In other words, the width in the main-scanning direction of the test pattern forming plate 16 is larger than the width W1 shown in FIG. 6 and the length in the recording medium conveying direction is larger than the length L1 shown in FIG. 6. The test pattern forming plate 16 with the above dimensions can receive all ink droplets jetted at once from all of the inkjet nozzles 10*a* of any one of the inkjet heads 10.

The image forming unit 2 of the first embodiment further includes the test pattern examination unit 17 configured to detect a test pattern formed on the test pattern forming plate 16 moving under the test pattern detection unit 17 from the image forming area A to the test pattern plate home position. Since the test pattern is detected while the test pattern forming plate 16 is moving back to the test pattern plate home position, there is no need to move the test pattern forming plate 16 just to detect the test pattern.

According to the second embodiment of the present invention, the image forming unit 2 includes the test pattern forming belt 26 in a space surrounded by the conveyor belt 14 and corresponding to the image forming area A. Also, the conveyor belt 14 has the openings 14*a* that allow ink droplets to pass through and to reach the test pattern forming belt 26 when the paper sheet P is not being conveyed. With this configuration, a test pattern is formed on the test pattern forming belt 26 that is positioned lower than the upper surface of the conveyor belt 14. In other words, the travel distance of ink droplets jetted to form a test pattern is larger than that of ink droplets jetted to form an image on the paper sheet P. Compared with a configuration where the travel distance of ink droplets for forming a test pattern is smaller than that of ink droplets for forming an image on the paper sheet P, the configuration of the second embodiment makes it easier to detect positional deviation of ink droplets and makes it possible to more accurately correct positional deviation of ink droplets.

Also, with the test pattern forming belt 26, it is possible to form test patterns two or more times in one image forming test.

According to a variation of the second embodiment, the conveyor belt 14 is composed of multiple belt parts arranged parallel to the recording medium conveying direction at certain intervals. The conveyor belt 14 allows ink droplets to pass through so that a test pattern can be formed on the test pattern forming belt 26.

According to the third embodiment, the image forming unit 2 includes the upstream conveying rollers 40 positioned upstream of the image forming area A in the recording medium conveying direction, the downstream conveying rollers 41 positioned downstream of the image forming area A in the recording medium conveying direction, and the paper guide 44 between the upstream conveying rollers 40 and the downstream conveying rollers 41. The upstream conveying rollers 40 and the downstream conveying rollers 41 feed the paper sheet P and the paper guide 44 supports and guides the paper sheet P. The paper guide 44 is composed of the guide ribs 44*a* and the openings 44*b* are formed between the guide ribs 44*a* so that ink droplets can pass through the paper guide 44 when the paper sheet P is not being conveyed. Thus, the paper guide 44 allows ink droplets to pass through so that a test pattern can be formed on the test pattern forming belt 26.

The control unit 90 (or the image forming test control unit) may be configured to form multiple test patterns on the test pattern forming plate 16 or the test pattern forming belt 26 in positions within the image forming area A and thereby to detect and correct positional deviation of ink droplets throughout the printable area of the carriage 11.

The image forming unit 2 according to an embodiment of the present invention includes the cleaning roller 15 to wipe off a test pattern formed on the test pattern forming plate 16 or the test pattern forming belt 26. The cleaning roller 15 makes it possible to use the test pattern forming plate 16 and the test pattern forming belt 26 repeatedly.

A water-repellent layer may be formed on the test pattern forming plate 16 and the test pattern forming belt 26. A water-repellent layer prevents ink droplets from penetrating into the test pattern forming plate 16 or the test pattern forming belt 26 and thereby makes it easier for the cleaning roller 15 to wipe off a test pattern.

The widths in the main-scanning direction of the test pattern forming plate 16 and the test pattern forming plate 26 are preferably made smaller than the width of the conveyor belt 14 or the paper guide 44 to reduce the width of the printer 1.

The image forming unit 2 may also include the ink temperature sensor 101 for detecting the temperature of ink in an ink container and the temperature recording unit 102 for recording the detected ink temperature. In this case, the control unit 90 (or the image forming test control unit) of the printer 1 may be configured to perform an image forming test if the change of the detected ink temperature is larger than a predetermined value. This configuration makes it possible to automatically perform an image forming test to detect positional deviation of ink droplets or an image density error based on the change in ink temperature.

As another example, the image forming unit 2 may include an ink viscosity sensor for detecting the viscosity of ink in an ink container and a viscosity recording unit instead of the ink temperature sensor 101 and the temperature recording unit 102. This configuration makes it possible to automatically perform an image forming test to detect positional deviation of ink droplets or an image density error based on the change in ink viscosity.

The control unit 90 (or the image forming test control unit) may be configured to perform an image forming test when the number of times ink droplets are jetted reaches a predetermined value. This configuration makes it possible to detect problems caused by degradation over time of inkjet heads.

Also, the control unit 90 (or the image forming test control unit) may be configured to perform an image forming test when the number of printed pages reaches a predetermined value to detect problems caused by degradation over time of inkjet heads.

Also, the control unit 90 (or the image forming test control unit) may be configured to perform an image forming test after the printer 1 is unused for a predetermined period of time to detect problems that may occur if the printer 1 is unused for a long time.

Also, the control unit 90 (or the corrective action control unit) may be configured to examine a test pattern detected by the test pattern detection unit 17 and to control an image forming process based on the examination results. For example, the control unit 90 may be configured to correct positional deviation of ink droplets based on the examination results.

Further, the control unit 90 (or the corrective action control unit) may be configured to correct positional deviation of ink droplets taking into account the difference between the travel distance of ink droplets jetted onto the test pattern forming plate 16 to form a test pattern and the travel distance of ink droplets jetted onto the paper sheet P to form an image.

The printer 1 may include the paper thickness sensor 501 for detecting the thickness of the paper sheet P and the control unit 90 (or the corrective action control unit) may be configured to correct positional deviation of ink droplets taking into account the detected thickness of the paper sheet P. This configuration makes it possible to automatically adjust landing positions of ink droplets even when the paper type is changed.

The printer 1 may include a recording medium thickness inputting unit such as an operations panel for inputting the thickness of the paper sheet P and the control unit 90 (or the corrective action control unit) may be configured to correct positional deviation of ink droplets taking into account the input thickness of the paper sheet P. This configuration makes it possible to adjust landing positions of ink droplets even when the paper type is changed. With this configuration, since no paper thickness sensor is needed, the production costs of the printer 1 may be reduced.

The printer 1 may include multiple paper feed trays 50 that can hold different types of papers. In this case, the recording medium thickness inputting unit may be configured to allow specification of paper thickness for each of the paper feed trays 50. This configuration makes it possible to adjust landing positions of ink droplets even when the paper feed trays 50 are switched from one to another during an image forming process.

The printer 1 may include a distance adjusting unit for moving the carriage 11 in a vertical direction and thereby adjusting the distance between the inkjet heads 10 and the paper sheet P and the control unit 90 (or the corrective action control unit) may be configured to adjust landing positions of ink droplets each time when the carriage 11 is moved in the vertical direction. This configuration makes it possible to accurately form an image even on a thick recording medium such as an envelope.

Positional deviation of ink droplets may be corrected by changing the timing of jetting ink droplets from the inkjet heads 10 according to a positional deviation correction value calculated based on a test pattern detected by the test pattern detection unit 17.

Positional deviation of ink droplets may also be corrected by changing the vertical position of the carriage 11 and thereby changing the distance between the nozzle surface of the inkjet head 10 and the upper surface of the conveyor belt 14 according to a positional deviation correction value calculated based on a test pattern detected by the test pattern detection unit 17.

Positional deviation of ink droplets may also be corrected by changing the moving speed in the main-scanning direction of the carriage 11 according to a positional deviation correction value calculated based on a test pattern detected by the test pattern detection unit 17.

The control unit 90 may include an inkjet problem detection unit for examining a test pattern and thereby detecting inkjet problems and the corrective action control unit may be configured to perform head maintenance if an inkjet problem is detected by the inkjet problem detection unit.

In this case, it is preferable to perform a test pattern forming step and a test pattern examination step again after the head maintenance is performed to make sure that the inkjet problem is corrected.

Also, it is more preferable to repeat the test pattern forming step, the test pattern examination step, and the head maintenance until the inkjet problem is corrected.

The control unit 90 may be configured to perform an inkjet problem correction process when the number of times ink droplets are jetted, the number of printed pages, or the unused period of time of the printer 1 reaches a predetermined value.

The control unit 90 may include an ink amount detection unit for calculating the amount of ink jetted onto the test image forming plate 16 based on a test pattern scanned by the test pattern detection unit 17 and the corrective action control unit may be configured to correct an image density error based on the calculated amount of ink. The control unit 90 (or the corrective action control unit) corrects an image density error, for example, by adjusting the amount of ink to be jetted from the inkjet heads 10 or by changing the number of ink droplets jetted onto the paper sheet P.

A test pattern for image density error detection is preferably formed as a monochrome pattern for each inkjet head 10 while moving the carriage 11 only in one direction to prevent image density change caused by positional deviation of ink droplets.

The present invention is not limited to the specifically disclosed embodiments, and variations and modifications may be made without departing from the scope of the present invention.

The present application is based on Japanese Priority Application No. 2006-188006, filed on Jul. 7, 2006, the entire contents of which are hereby incorporated herein by reference.

What is claimed is:

1. An image forming apparatus for forming an image on a recording medium, comprising:

an inkjet head having a nozzle surface and inkjet nozzles on the nozzle surface and configured to jet ink droplets from the inkjet nozzles;

a recording medium conveying mechanism including a recording medium conveyor and configured to convey the recording medium by the recording medium conveyor into an image forming area facing the inkjet head;

a test pattern forming part provided separately from the recording medium conveyor;

a control unit configured to perform an image forming test where a test pattern is formed on the test pattern forming part by jetting ink droplets from the inkjet head; and a test pattern detection unit configured to detect the test pattern formed on the test pattern forming part, wherein the test pattern forming part is in a home position outside of the image forming area when the test pattern is not being formed and moves into the image forming area when the test pattern is formed, wherein the test pattern forming part is in a home position outside of the image forming area when the test pattern is not being formed and moves into the image forming area when the test pattern is formed.

2. The image forming apparatus as claimed in claim 1, further comprising:

a drive transmission unit configured to transmit a driving force from the recording medium conveying mechanism to the test pattern forming part.

3. The image forming apparatus as claimed in claim 1, wherein a thickness of the test pattern forming part is smaller than a gap between the nozzle surface of the inkjet head and the recording medium conveyor.

4. The image forming apparatus as claimed in claim 1, wherein a width of the test pattern forming part is larger than that of an image that the inkjet head can form by jetting ink droplets once.

5. The image forming apparatus as claimed in claim 1, wherein the test pattern detection unit is positioned and configured to detect the test pattern formed on the test pattern forming part at a point in a path along which the test pattern forming part moves from the image forming area to the home position.

6. An image forming apparatus for forming an image on a recording medium, comprising:

an inkjet head having a nozzle surface and inkjet nozzles on the nozzle surface and configured to jet ink droplets from the inkjet nozzles;

a recording medium conveying mechanism including a recording medium conveyor and configured to convey the recording medium by the recording medium conveyor into an image forming area facing the inkjet head;

a test pattern forming part provided separately from the recording medium conveyor;

a control unit configured to perform an image forming test where a test pattern is formed on the test pattern forming part by jetting ink droplets from the inkjet head; and a test pattern detection unit configured to detect the test pattern formed on the test pattern forming part, wherein the test pattern forming part is disposed in a space under or surrounded by the recording medium conveyor and corresponding to the image forming area; and the recording medium conveyor is configured to allow ink droplets jetted from the inkjet head to path therethrough when the recording medium is not being conveyed.

7. The image forming apparatus as claimed in claim 6, wherein the test pattern forming part is an endless belt.

8. The image forming apparatus as claimed in claim 6, wherein the recording medium conveyor is an endless belt having an opening that allows ink droplets jetted from the inkjet head to path therethrough when the recording medium is not being conveyed.

9. The image forming apparatus as claimed in claim 7, wherein the recording medium conveyor is an endless belt composed of multiple belt parts arranged at intervals parallel to a recording medium conveying direction.

10. The image forming apparatus as claimed in claim 7, wherein the recording medium conveyor includes a conveying force applying part positioned upstream of the image forming area in a recording medium conveying direction and configured to feed the recording medium; and a recording medium guide configured to guide the recording medium in the recording medium conveying direction from a position upstream of the image forming area to a position downstream of the image forming area, the recording medium guide having an opening that allows ink droplets jetted from the inkjet head to path therethrough when the recording medium is not being conveyed.

11. The image forming apparatus as claimed in claim 1, wherein the control unit is configured to form multiple test patterns on the test pattern forming part in positions within the image forming area.

12. The image forming apparatus as claimed in claim 1, further comprising:

a cleaning unit configured to remove the test pattern formed on the test pattern forming part.

13. The image forming apparatus as claimed in claim 1, wherein a water-repellent layer is formed on a surface of the test pattern forming part.

14. The image forming apparatus as claimed in claim 1, wherein a width of the test pattern forming part is smaller than that of the recording medium conveyor.

15. The image forming apparatus as claimed in claim 1, further comprising:

an ink container for containing ink to be jetted from the inkjet head;

an ink temperature detection unit configured to detect a temperature of the ink in the ink container; and a temperature recording unit configured to record the detected temperature of the ink;

wherein the control unit is configured to determine whether to perform the image forming test based on a difference between the detected temperature of the in and a previous temperature of the ink recorded in the temperature recording unit.

16. The image forming apparatus as claimed in claim 1, further comprising:

an ink container for containing ink to be jetted from the inkjet head;

an ink viscosity detection unit configured to detect a viscosity of the ink in the ink container; and a viscosity recording unit configured to record the detected viscosity of the ink;

wherein the control unit is configured to determine whether to perform the image forming test based on a difference between the detected viscosity of the ink and a previous viscosity of the ink recorded in the viscosity recording unit.

17. The image forming apparatus as claimed in claim 1, wherein the control unit is configured to perform the image forming test when a number of times ink droplets are jetted from the inkjet head reaches a predetermined value.

18. The image forming apparatus as claimed in claim 1, wherein the control unit is configured to perform the image forming test when a number of printed pages reaches a predetermined value.

19. The image forming apparatus as claimed in claim 1, wherein the control unit is configured to perform the image forming test after the image forming apparatus is unused for a predetermined period of time.

* * * * *